US012077831B2

(12) United States Patent
Yoshioka et al.

(10) Patent No.: US 12,077,831 B2
(45) **Date of Patent: *Sep. 3, 2024**

(54) STEEL SHEET, MEMBER, AND METHODS FOR PRODUCING THEM

(71) Applicant: JFE STEEL CORPORATION, Tokyo (JP)

(72) Inventors: Shimpei Yoshioka, Tokyo (JP); Yoshihiko Ono, Tokyo (JP); Yuma Honda, Tokyo (JP); Nobuyuki Nakamura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 612 days.

This patent is subject to a terminal disclaimer.

(21) Appl. No.: 17/415,532

(22) PCT Filed: Oct. 25, 2019

(86) PCT No.: PCT/JP2019/041817

§ 371 (c)(1),
(2) Date: Jun. 17, 2021

(87) PCT Pub. No.: WO2020/129402

PCT Pub. Date: Jun. 25, 2020

(65) Prior Publication Data

US 2022/0056549 A1 Feb. 24, 2022

(30) Foreign Application Priority Data

Dec. 21, 2018 (JP) ..... 2018-238963

(51) Int. Cl.
*C21D 9/46* (2006.01)
*B22D 11/18* (2006.01)
(Continued)

(52) U.S. Cl.
CPC ..... *C21D 9/46* (2013.01); *B22D 11/182* (2013.01); *C21D 8/0226* (2013.01);
(Continued)

(58) Field of Classification Search
None
See application file for complete search history.

(56) References Cited

U.S. PATENT DOCUMENTS

2018/0100212 A1* 4/2018 Ono ..... C21D 8/0236
2018/0135145 A1 5/2018 Suwa et al.
2019/0040483 A1 2/2019 Kimata et al.

FOREIGN PATENT DOCUMENTS

CN 106574340 A 4/2017
CN 107208234 A 9/2017
(Continued)

OTHER PUBLICATIONS

Jun. 9, 2022 Office Action issued in Chinese Patent Application No. 201980083948.9.
(Continued)

*Primary Examiner* — Anthony M Liang
(74) *Attorney, Agent, or Firm* — Oliff PLC

(57) ABSTRACT

A steel sheet having a specified chemical composition and a tensile strength of 1,320 MPa or more, and methods for producing the steel sheet. The steel sheet has a specified microstructure including martensite and bainite, the total area fraction of the martensite and the bainite being 95% or more and 100% or less, the balance being one or more selected from ferrite and retained austenite. The forumulae [% Ti]+[% Nb]>0.007 and [% Ti]×[% Nb]$^2$≤7.5×10$^{-6}$ are satisfied in the chemical composition.

16 Claims, 1 Drawing Sheet

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C23C 2/06*** | (2006.01) |

(52) U.S. Cl.

CPC ..... *C21D 8/0236* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C23C 2/06* (2013.01); *C21D 2211/001* (2013.01); *C21D 2211/002* (2013.01); *C21D 2211/005* (2013.01); *C21D 2211/008* (2013.01)

(56) References Cited

FOREIGN PATENT DOCUMENTS

| | | | | |
|---|---|---|---|---|
| CN | 107429349 | A | 12/2017 | |
| EP | 3 080 322 | A1 | 10/2016 | |
| EP | 3 178 957 | A1 | 6/2017 | |
| EP | 3 276 022 | A1 | 1/2018 | |
| EP | 3418419 | A1 | 12/2018 | |
| EP | 3489382 | A1 | 5/2019 | |
| JP | S54-31019 | A | 3/1979 | |
| JP | 3514276 | B2 | 3/2004 | |
| JP | 2007-002276 | A | 1/2007 | |
| JP | 4427010 | B2 | 3/2010 | |
| JP | 5428705 | B2 | 2/2014 | |
| JP | 2015-155572 | A | 8/2015 | |
| JP | 5824401 | B2 | 11/2015 | |
| JP | 2016-153524 | A | 8/2016 | |
| JP | 2017-066453 | A | 4/2017 | |
| JP | 6112261 | B | 4/2017 | |
| WO | WO-2016152163 | A1 * | 9/2016 | ..... C21D 8/0236 |
| WO | 2016/163469 | A1 | 10/2016 | |
| WO | 2017/138504 | A1 | 8/2017 | |
| WO | 2017168958 | A1 | 10/2017 | |
| WO | 2018062380 | A1 | 4/2018 | |

OTHER PUBLICATIONS

Sep. 13, 2021 Extended Search Report issued in European Patent Application No. 19897728.2.

Van der Spuy, D. et al. "An Optimization Procedure for the Secondary Cooling Zone of a Continuous Billet Caster," The Journal of the South African Institute of Mining and Metallury, Jan./Feb. 1999. pp. 49-56.

Fehervari, Gabor et al., "Analysis of the Effect of Casting Parameters on Continuous Steel Casting," Material Science Forums, vols. 414-415, 2003, pp. 395-404.

Brezina, Michal et al. "Comparison of Optimization-Regulation Algorithms for Secondary Cooling in Continuous Steel Casting," Metals, Feb. 1, 2021, pp. 1-19.

Apr. 7, 2023 Office Action issued in Korean Patent Application No. 2021-7018594.

Jan. 28, 2020 International Search Report issued in International Application No. PCT/JP2019/041817.

Dec. 26, 2023 Office Action issued in U.S. Appl. No. 17/415,462.

* cited by examiner

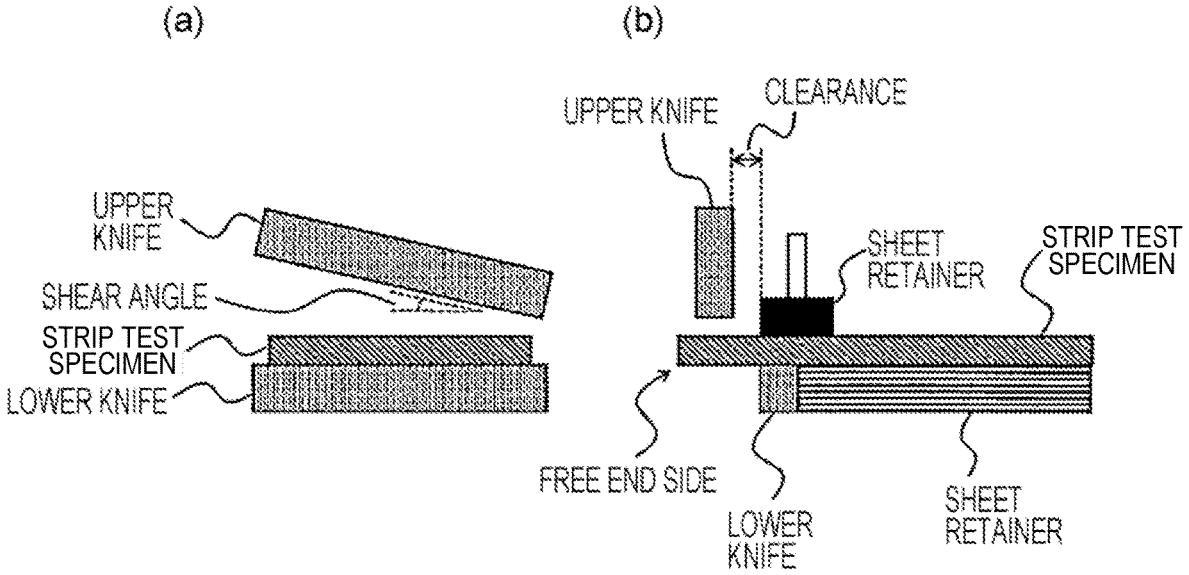
(a)
UPPER KNIFE
SHEAR ANGLE
STRIP TEST SPECIMEN
LOWER KNIFE
(b)
UPPER KNIFE
CLEARANCE
SHEET RETAINER
STRIP TEST SPECIMEN
FREE END SIDE
LOWER KNIFE
SHEET RETAINER

STEEL SHEET, MEMBER, AND METHODS FOR PRODUCING THEM

TECHNICAL FIELD

This application relates to a high-strength steel sheet for cold press forming, a member, and methods for producing them, the steel sheet and the member being subjected to a cold press forming process and used, for example, in automobiles and electrical household appliances.

BACKGROUND

In recent years, with an increasing demand for reductions in the weights of automotive bodies, there have been advances in the use of high-strength steel sheets with 1,320 to 1,470 MPa-grade tensile strength (TS) to vehicle frame components, such as center pillar reinforcements (R/F), bumpers, impact beam components, etc. In order to further reduce the weights of automotive bodies, studies of the application of steel sheets having 1.8 GPa grade or higher strength are also being started. Hitherto, studies have been conducted on increasing the strength by hot press, i.e., pressing at a high temperature. The use of high-strength steels in cold press has recently been studied again from the viewpoints of cost and productivity.

However, in the case where a high-strength steel sheet with 1,320 MPa-grade or higher TS is formed into a component by cold pressing, an increase in residual stress inside the component and a deterioration in the delayed fracture resistance of the steel itself result in a manifestation of delayed fracture. Delayed fracture is a phenomenon where, when a component is placed in a hydrogen penetration environment while a high stress is applied to the component, hydrogen that penetrates into the steel sheet reduces the interatomic bonding forces and causes local deformation in the steel sheet, which leads to formation of microcracks, and the component is fractured as a result of the propagation of the microcracks. The delayed fracture of actual components occurs primarily at an edge surface of the steel sheet cut by shearing or punching. For this reason, in an actual component, many attempts have been made to improve delayed fracture resistance of a base steel sheet having visible cracks with a size of 1 mm or more. In contrast, minute delayed fracture having a size of several hundred micrometers occurring at a cut edge surface has not been regarded as a problem until now. However, such minute delayed fracture may also deteriorate fatigue properties and coating adhesion, which may adversely affect component performance. For this reason, there is a need for a steel sheet with excellent delayed fracture resistance not only in the base steel sheet but also at the cut edge surface.

Various techniques for improving the delayed fracture resistance of steel sheets have been disclosed. For example, on the basis of the finding that for the same strength, a higher additive element content results in lower delayed-fracture resistance, Patent Literature 1 discloses an ultrahigh-strength steel sheet having excellent delayed fracture resistance, the steel sheet containing C: 0.008% to 0.18%, Si: 1% or less, Mn: 1.2% to 1.8%, S: 0.01% or less, N: 0.005% or less, and O: 0.005% or less, the relationship between Ceq and TS satisfying $TS \leq 2{,}270 \times Ceq + 260$, $Ceq \leq 0.5$, and $Ceq = C + Si/24 + Mn/6$, the microstructure containing martensite in a volume fraction of 80% or more.

Patent Literatures 2, 3, and 4 each disclose a technique for preventing hydrogen-induced cracking by reducing the S content of steel to a predetermined level and adding Ca to the steel.

Patent Literature 5 discloses a technique for improving delayed fracture resistance by incorporating one or two or more of V: 0.05% to 2.82%, Mo: 0.1% or more and less than 3.0%, Ti: 0.03% to 1.24%, and Nb: 0.05% to 0.95% into a steel containing C: 0.1% to 0.5%, Si: 0.10% to 2%, Mn: 0.44% to 3%, N: 0.008% or less, and Al: 0.005% to 0.1% to disperse fine alloy carbide particles serving as hydrogen-trapping sites.

Patent Literature 6 discloses a technique for improving delayed fracture resistance by containing C: 0.15% or more and 0.40% or less, Si: 1.5% or less, Mn: 0.9% to 1.7%, P: 0.03% or less, S: less than 0.0020%, sol. Al: 0.2% or less, N: less than 0.0055%, and O: 0.0025% or less, reducing the number of coarse inclusions, and finely dispersing carbides.

Patent Literature 7 discloses a technique for reducing residual stress and suppressing delayed fracture that occurs on a cut edge surface by subjecting a steel sheet having a single-phase martensite microstructure to a leveling process.

Patent Literature 8 discloses an ultrahigh-strength steel sheet containing, by area fraction, 90% or more martensite and 0.5% or more retained austenite, having TS 1,470 MPa, and having excellent delayed fracture resistance at a cut edge surface.

CITATION LIST

Patent Literature

PTL 1: Japanese Patent No. 3514276
PTL 2: Japanese Patent No. 5428705
PTL 3: Japanese Unexamined Patent Application Publication No. 54-31019
PTL 4: Japanese Patent No. 5824401
PTL 5: Japanese Patent No. 4427010
PTL 6: Japanese Patent No. 6112261
PTL 7: Japanese Unexamined Patent Application Publication No. 2015-155572
PTL 8: Japanese Unexamined Patent Application Publication No. 2016-153524

SUMMARY

Technical Problem

Each of the techniques disclosed in Patent Literatures 1 to 6 suppresses large cracks having a size of several millimeters due to delayed fracture occurring in the base steel sheet and cannot sufficiently suppress microcracks having a size of several hundred micrometers due to delayed fracture occurring at a cut edge surface itself. In the technique disclosed in Patent Literature 7, the base steel sheet needs to be subjected to the leveling process, and thus the delayed fracture properties of the base steel sheet may be deteriorated through a decrease in bendability due to processing strain introduced by the leveling. Regarding an automotive component that is subjected to severe cold working after cutting, in the steel in which residual austenite is dispersed, which is disclosed in Patent Literature 8, the retained austenite may be transformed into hard martensite after the formation of the component to deteriorate the delayed fracture resistance of the base steel sheet. The disclosed embodiments have been accomplished in order to solve these problems and aims to provide a steel sheet having TS 1,320 MPa and a beneficial effect on the suppression of not just delayed fracture that occurs in a base steel sheet but also delayed fracture that occurs at a cut edge surface itself, a member, and methods for producing them.

Solution to Problem

To solve the foregoing problems, the inventors have conducted intensive studies and have obtained the following findings.

1) The reduction of only the number of inclusions having a diameter of 100 μm or more, which have been conventionally considered to adversely affect bendability, does not result in sufficient delayed fracture resistance of an ultra-high-strength steel sheet having TS 1,320 MPa at a punched edge surface. It has been found that even in the case of fine particles, inclusion clusters each including one or more inclusion particles and each having a long-axis cluster length of 20 to 80 μm had a significantly adverse effect on the delayed fracture resistance at the punched edge surface. The individual inclusion particles in the inclusion cluster are mainly composed of a Mn-, Ti-, Zr-, Ca-, or REM-based sulfide, an Al-, Ca-, Mg-, Si-, or Na-based oxide, a Ti-, Zr-, Nb-, or Al-based nitride, or a Ti-, Nb-, Zr-, or Mo-based carbide, or are complex precipitates thereof, and do not contain iron-based carbide.

2) It was found that in order to appropriately control the inclusion clusters having a length of 20 to 80 μm, it was necessary to optimize the amounts of N, S, O, Mn, Nb, and Ti contained in steel, the slab heating temperature, and the heating holding time.

3) One of the main causes for delayed fracture occurring at a cut edge surface is a decrease in grain boundary strength due to P segregating at prior austenite grain boundaries. It is important not only to reduce the P content itself but also to control its concentration distribution.

4) Moreover, in the case where a Mn-rich region is present at or near the center of the steel sheet in the thickness direction, delayed fracture properties at a cut edge surface deteriorate through the formation of inclusions mainly composed of MnS and an increase in material strength; thus, it is also important to control the concentration distribution of Mn.

The disclosed embodiments have been accomplished on the basis of the above findings. Specifically, the disclosed embodiments provide the following.

[1] A steel sheet has a component composition containing, by mass %, C: 0.13% or more and 0.40% or less, Si: 1.5% or less, Mn: 1.7% or less, P: 0.010% or less, S: 0.0020% or less, sol. Al: 0.20% or less, N: less than 0.0055%, O: 0.0025% or less, Nb: 0.002% or more and 0.035% or less, Ti: 0.002% or more and 0.10% or less, and B: 0.0002% or more and 0.0035% or less, formulae (1) and (2) described below being satisfied, the balance being Fe and incidental impurities; and a microstructure containing martensite and bainite, the total area fraction of the martensite and the bainite being 95% or more and 100% or less, the balance being one or more selected from ferrite and retained austenite, and the total of the density of inclusion particles having a long-axis length of 20 μm or more and 80 μm or less and a minimum interparticle distance of more than 10 μm and the density of inclusion particle clusters each having a long-axis cluster length of 20 μm or more and 80 μm or less and each including two or more inclusion particles having a long-axis length of 0.3 μm or more and a minimum interparticle distance of 10 μm or less being 5 pieces/mm$^2$ or less, in which a local P concentration in a region extending from a position 1/4 of the thickness of the steel sheet in the thickness direction from a surface of the steel sheet to a position 3/4 of the thickness of the steel sheet in the thickness direction from the surface of the steel sheet is 0.060% or less by mass, and the degree of Mn segregation in the region is 1.50 or less, and the steel sheet has a tensile strength of 1,320 MPa or more, $$[\%\ Ti]+[\%\ Nb]>0.007 \quad (1)$$

$$[\%\ Ti]\times[\%\ Nb]^2\leq 7.5\times10^{-6} \quad (2)$$

where in each of formulae (1) and (2), [% Nb] and [% Ti] are the Nb content (%) and the Ti content (%), respectively, of steel.

[2] In the steel sheet described in [1], the component composition further contains, by mass %, one or more selected from Cu: 0.01% or more and 1% or less and Ni: 0.01% or more and 1% or less.

[3] In the steel sheet described in [1] or [2], the component composition further contains, by mass %, one or more selected from Cr: 0.01% or more and 1.0% or less, Mo: 0.01% or more and less than 0.3%, V: 0.003% or more and 0.45% or less, Zr: 0.005% or more and 0.2% or less, and W: 0.005% or more and 0.2% or less.

[4] In the steel sheet described in any one of [1] to [3], the component composition further contains, by mass %, one or more selected from Sb: 0.002% or more and 0.1% or less, and Sn: 0.002% or more and 0.1% or less.

[5] In the steel sheet described in any one of [1] to [4], the component composition further contains, by mass %, one or more selected from Ca: 0.0002% or more and 0.0050% or less, Mg: 0.0002% or more and 0.01% or less, and a REM: 0.0002% or more and 0.01% or less.

[6] The steel sheet described in any one of [1] to [5] further includes a zinc-coated layer on the surface.

[7] A method for producing a steel sheet includes, in performing continuous casting of a slab from a molten steel having the component composition described in any one of [1] to [5] at a difference between a casting temperature and a solidification temperature of 10° C. or higher and 40° C. or lower, the continuous casting including cooling the slab at a specific water flow of 0.5 L/kg or more and 2.5 L/kg or less until the temperature of a surface layer portion of a solidifying shell reaches 900° C. in a secondary cooling zone, and passing the slab having a temperature of 600° C. or higher and 1,100° C. or lower through a bending zone and a straightening zone, subsequently, holding the surface temperature of the slab at 1,220° C. or higher for 30 minutes or more, then hot-rolling the slab into a hot-rolled steel sheet, cold-rolling the hot-rolled steel sheet at a cold rolling reduction rate of 40% or more into a cold-rolled steel sheet, and performing continuous annealing of the cold-rolled steel sheet, the continuous annealing including subjecting the cold-rolled steel sheet to soaking treatment at 800° C. or higher for 240 seconds or more, cooling the steel sheet from a temperature of 680° C. or higher to a temperature of 260° C. or lower at an average cooling rate of 70° C./s or more, reheating the steel sheet as needed, and then holding the steel sheet in a temperature range of 150° C. to 260° C. for 20 to 1,500 seconds.

[8] In the method for producing a steel sheet described in [7], after the continuous annealing, a coating treatment is performed.

[9] A member is obtained by subjecting the steel sheet described in any one of [1] to [6] to at least one of forming and welding.

[10] A method for producing a member includes a step of subjecting a steel sheet produced by the method for producing a steel sheet described in [7] or [8] to at least one of forming and welding.

Advantageous Effects

According to the disclosed embodiments, it is possible to provide a high-strength steel sheet having excellent resistance not only to delayed fracture that occurs in the base steel sheet but also to delayed fracture at a cut edge surface itself. The high-strength steel sheet having such improved delayed fracture resistance can be used for cold press forming that involves shearing and punching, and can contribute to a reduction in weight and an improvement in the strength of a member.

BRIEF DESCRIPTION OF THE DRAWINGS

FIG. 1 is a schematic view illustrating shearing to form an edge surface.

DETAILED DESCRIPTION

While embodiments will be described below, the disclosure is not intended to be limited to the following specific embodiments. First, the component composition of a steel sheet according to an embodiment will be described. In the description of the component composition, the units of the amounts of elements contained are "%", which refers to "% by mass".

C: 0.13% or More and 0.40% or Less

C is contained in order to improve hardenability to obtain a microstructure containing 95% or more martensite or bainite. C is contained in order to increase the strength of martensite or bainite to ensure TS 1,320 MPa. C is contained in order to form fine carbide particles serving as hydrogen-trapping sites. A C content of less than 0.13% results in a failure to achieve predetermined strength while maintaining excellent delayed fracture resistance. Accordingly, the C content needs to be 0.13% or more. To obtain TS≥1,470 MPa while maintaining excellent delayed fracture resistance, the C content is preferably 0.18% or more, more preferably 0.19% or more. A C content of more than 0.40% results in excessively high strength to make it difficult to obtain sufficient delayed fracture resistance. Accordingly, the C content needs to be 0.40% or less. The C content is preferably 0.38% or less, more preferably 0.34% or less.

Si: 1.5% or Less

Si is contained as a strengthening element through solid-solution hardening. Si is contained in order to improve the delayed fracture resistance by suppressing the formation of film-like carbide when tempering is performed at a temperature of 200° C. or higher. Si is contained in order to reduce the segregation of Mn at the center of the steel sheet in the thickness direction to suppress the formation of MnS. The lower limit of Si need not be specified. To provide the foregoing effects, the Si content is preferably 0.02% or more, more preferably 0.1% or more. A Si content of more than 1.5% results in a large amount of Si segregated to deteriorate the delayed fracture resistance. A Si content of more than 1.5% results in a significant increase in rolling load during hot rolling and cold rolling. Moreover, a Si content of more than 1.5% results in a decrease in the toughness of the steel sheet. Accordingly, the Si content needs to be 1.5% or less. The Si content is preferably 0.9% or less, more preferably 0.7% or less.

Mn: 1.7% or Less

Mn is contained in order to improve the hardenability of steel to allow the total area fraction of martensite and bainite to fall within a predetermined range. Moreover, Mn is contained in order to immobilize S in steel in the form of MnS to reduce hot shortness. Mn is an element that promotes the formation and coarsening of MnS at the center of the steel sheet in the thickness direction and combines with particles of inclusions, such as $Al_2O_3$, (Nb, Ti) (C, N), TiN, and TiS, to precipitate. These can be avoided by controlling the segregation state of Mn. To maintain welding stability, however, the Mn content needs to be 1.7% or less. The Mn content is preferably 1.6% or less, more preferably 1.5% or less. The lower limit need not be particularly limited. To stably achieve a predetermined total area fraction of the martensite and bainite on an industrial scale, the Mn content is preferably 0.2% or more, more preferably 0.4% or more.

P: 0.010% or Less

P is an element that strengthens steel. However, a high P content results in significant deteriorations in delayed fracture resistance and spot weldability. Accordingly, the P content needs to be 0.010% or less. The P content is preferably 0.008% or less, more preferably 0.006% or less. The lower limit of P need not be specified. To obtain a P content of the steel sheet of less than 0.002%, a heavy load is applied to refining, which deteriorates production efficiency. Accordingly, the P content is preferably 0.002% or more.

S: 0.0020% or Less

S needs to be precisely controlled because S forms, for example, MnS, TiS, and Ti(C, S) and thus has a potent effect on delayed fracture resistance. The reduction only of the number of coarse MnS inclusions having a size of more than 80 μm, which have been conventionally considered to adversely affect bendability, is insufficient. The number of inclusion particles precipitated by combining MnS with particles of inclusions, such as $Al_2O_3$, (Nb, Ti) (C, N), TiN, and TiS, are also required to be reduced to adjust the microstructure of the steel sheet. This adjustment results in excellent delayed fracture resistance. To reduce the foregoing adverse effects of the inclusion clusters, the S content needs to be 0.0020% or less. To further improve the delayed fracture resistance, the S content is preferably 0.0010% or less, more preferably 0.0006% or less. The lower limit of S need not be specified. To obtain a S content of the steel sheet of less than 0.0002%, a heavy load is applied to refining, which deteriorates production efficiency. Accordingly, the S content is preferably 0.0002% or more.

Sol. Al: 0.20% or Less

Al is added in order to perform sufficient deoxidation to reduce the number of inclusions in steel. The lower limit of sol. Al need not be specified. To stably perform deoxidation, the sol. Al content is preferably 0.01% or more, more preferably 0.02% or more. A sol. Al content of more than 0.20% results in a deterioration in delayed fracture resistance because cementite formed during coiling is not easily dissolved during an annealing process. Accordingly, the sol. Al content needs to be 0.20% or less. The sol. Al content is preferably 0.10% or less, more preferably 0.05% or less.

N: Less Than 0.0055%

N is an element that forms inclusions of nitride and carbonitride, such as TiN, (Nb, Ti) (C, N), and AlN, in steel. When these inclusions are formed, the steel sheet cannot be adjusted to have a target microstructure, thus deteriorating the delayed fracture resistance. Accordingly, the N content needs to be less than 0.0055%. The N content is preferably 0.0050% or less, more preferably 0.0045% or less. The lower limit of N need not be specified. To suppress a decrease in production efficiency, the N content is preferably 0.0005% or more.

O: 0.0025% or Less

O forms granular oxide-based inclusions, such as $Al_2O_3$, $SiO_2$, CaO, and MgO, having a diameter of 1 to 20 μm in steel and also combines with Al, Si, Mn, Na, Ca, or Mg to form low-melting-point inclusions. The formation of these inclusions deteriorates the delayed fracture resistance. These inclusions deteriorate the smoothness of a sheared surface to increase local residual stress; thus, these inclusions by themselves deteriorate the delayed fracture resistance. To reduce these adverse effects, the O content needs to be 0.0025% or less. The O content is preferably 0.0018% or less, more preferably 0.0010% or less. The lower limit of O need not be specified. To suppress a decrease in production efficiency, the O content is preferably 0.0005% or more.

Nb: 0.002% or More and 0.035% or Less

Nb contributes to an increase in strength through refinement of the internal structures of martensite and bainite, improving the delayed fracture resistance. To provide these effects, the Nb content needs to be 0.002% or more. The Nb content is preferably 0.004% or more, more preferably 0.006% or more. A Nb content of more than 0.035% may result in the formation of a large number of Nb-based inclusion clusters distributed in a sequence of dots in the rolling direction to adversely affect the delayed fracture resistance. To reduce the adverse effect, the Nb content needs to be 0.035% or less. The Nb content is preferably 0.025% or less, more preferably 0.020% or less.

Ti: 0.002% or More and 0.10% or Less

Ti contributes to an increase in strength through refinement of the internal structures of martensite and bainite. Ti improves the delayed fracture resistance through the formation of fine Ti-based carbide and carbonitride particles serving as hydrogen-trapping sites. Moreover, Ti improves castability. To provide these effects, the Ti content needs to be 0.002% or more. The Ti content is preferably 0.006% or more, more preferably 0.010% or more. An excessively high Ti content may result in the formation of a large number of Ti-based inclusion particle clusters distributed in a sequence of dots in the rolling direction to adversely affect the delayed fracture resistance. To reduce the adverse effect, the Ti content needs to be 0.10% or less. The Ti content is preferably 0.06% or less, more preferably 0.03% or less.

B: 0.0002% or More and 0.0035% or Less

B is an element that improves the hardenability of steel to form martensite and bainite with predetermined area fractions even at a low Mn content. To provide these effects of B, the B content needs to be 0.0002% or more. The B content is preferably 0.0005% or more, more preferably 0.0010% or more. To fix N, B is preferably added in combination with 0.002% or more of Ti. A B content of more than 0.0035% results in not only saturation of the effects but also a decrease in the dissolution rate of cementite during annealing to cause some cementite to remain undissolved, thus deteriorating the delayed fracture resistance. Accordingly, the B content needs to be 0.0035% or less. The B content is preferably 0.0030% or less, more preferably 0.0025% or less.

Ti and Nb: Formulae (1) and (2) are satisfied:

$$[\%\ Ti]+[\%\ Nb]>0.007 \quad (1)$$

$$[\%\ Ti]\times[\%\ Nb]^2\leq 7.5\times10^{-6} \quad (2)$$

where [% Nb] and [% Ti] in formulae (1) and (2) are the Nb content (%) and the Ti content (%), respectively, of steel.

To reduce the effect of a deterioration in delayed fracture properties due to coarse precipitates of Ti and Nb while the control of the texture and the hydrogen-trapping effect of the fine precipitates owing to the addition of Ti and Nb are ensured, the Ti content and the Nb content need to be controlled within predetermined ranges.

To provide the texture-controlling effect and the hydrogen-trapping effect of the fine precipitates owing to the addition of Ti and Nb, Nb and Ti need to satisfy formula (1) described above. In particular, in the case of a steel containing 0.21% or more C, because the solid solubility limit of Nb is low, when Nb and Ti are added in combination, (Nb, Ti) (C, N) and (Nb, Ti) (C, S), which are very stable even at a high temperature of 1,200° C. or higher, are easily formed; thus, the solid solubility limits of Nb and Ti are significantly lowered. To reduce undissolved precipitates caused by a decrease in solid solubility limit, Nb and Ti need to satisfy formula (2) above.

The steel sheet according to the embodiment may contain one or more selected from elements described below, as needed.

Cu: 0.01% or More and 1% or Less

Cu is an element that improves corrosion resistance in a usage environment of automobiles. When Cu is contained, the following effects are provided: the corrosion product covers the surfaces of the steel sheet to inhibit the permeation of hydrogen into the steel sheet. Cu is an element that enters steel when scrap is used as a raw material. Accepting the entry of Cu enables recycled materials to be reused as raw materials and can reduce the production costs. To provide these effects, the Cu content is preferably 0.01% or more. To further improve the delayed fracture resistance of the steel sheet, the Cu content is more preferably 0.05% or more, even more preferably 0.08% or more. An excessively high Cu content may result in surface defects. Accordingly, the Cu content is preferably 1% or less. The Cu content is more preferably 0.6% or less, even more preferably 0.3% or less.

Ni: 0.01% or More and 1% or Less

Ni is an element that improves corrosion resistance. Ni is also effective in reducing surface defects easily caused by the incorporation of Cu. Accordingly, the Ni content is preferably 0.01% or more. The Ni content is more preferably 0.04% or more, even more preferably 0.06% or more. An excessively high Ni content results in nonuniform scale formation in a heating furnace to become a cause of surface defects and significantly increase costs. Accordingly, the Ni content is preferably 1% or less. The Ni content is more preferably 0.6% or less, even more preferably 0.3% or less.

The steel sheet according to the embodiment may further contain one or more selected from elements described below, as needed.

Cr: 0.01% or More and 1.0% or Less

Cr is an element that improves the hardenability of steel. To provide the effect, the Cr content is preferably 0.01% or more. The Cr content is more preferably 0.04% or more, more preferably 0.08% or more. A Cr content of more than 1.0% may result in a decrease in the dissolution rate of cementite during annealing to cause some cementite to remain undissolved, thus deteriorating the delayed fracture resistance. A Cr content of more than 1.0% may result in deteriorations in pitting corrosion resistance and phosphatability. Accordingly, the Cr content is preferably 1.0% or less. At a Cr content of more than 0.2%, the delayed fracture resistance, the pitting corrosion resistance, and the phosphatability tend to deteriorate. To suppress these, the Cr content is more preferably 0.2% or less, even more preferably 0.15% or less.

Mo: 0.01% or More and Less Than 0.3%

Mo is an element that improves the hardenability of steel, that forms Mo-containing fine carbide particles serving as hydrogen-trapping sites, and that refines martensite to improve the delayed fracture resistance. The incorporation of large amounts of Ti and Nb forms coarse precipitates thereof to deteriorate the delayed fracture resistance on the contrary. To deal with this, because the solid solution limit of Mo is larger than those of Nb and Ti, when Mo is contained in combination with Ti and Nb, the resulting precipitates are reduced in size, so that fine complex precipitates of Mo, Ti, and Nb are formed. Thus, the incorporation of Mo in combination with small amounts of Nb and Ti results in refinement of the microstructure without leaving coarse precipitates and enables a large amount of fine carbide to disperse, thereby improving the delayed fracture resistance. Accordingly, the Mo content is preferably 0.01% or more. The Mo content is more preferably 0.04% or more, even more preferably 0.08% or more. A Mo content of 0.3% or more may result in a deterioration in phosphatability. Accordingly, the Mo content is preferably less than 0.3%. The Mo content is more preferably 0.2% or less, even more preferably 0.15% or less.

V: 0.003% or More and 0.45% or Less

V is an element that improves the hardenability of steel, that forms V-containing fine carbide particles serving as hydrogen-trapping sites, and that refines martensite to improve the delayed fracture resistance. The V content is preferably 0.003% or more. The V content is more preferably 0.006% or more, even more preferably 0.010% or more. A V content of more than 0.45% may result in a significant deterioration in castability. Accordingly, the V content is preferably 0.45% or less. The V content is more preferably 0.30% or less, even more preferably 0.15% or less.

Zr: 0.005% or More and 0.2% or Less

Zr is an element that contributes to an increase in strength and an improvement in delayed fracture resistance through a reduction in prior-austenite grain size and reductions in, for example, block size and Bain grain size, which are internal structural units of martensite and bainite. Moreover, Zr is an element that increases the strength and improves the delayed fracture resistance through the formation of fine Zr-based carbide and carbonitride particles serving as hydrogen-trapping sites. Zr is also an element that improves castability. To provide these effects, the Zr content is preferably 0.005% or more. The Zr content is more preferably 0.008% or more, even more preferably 0.010% or more. A Zr content of more than 0.2% may result in the increase of coarse ZrN- and ZrS-based precipitates that remain undissolved during slab heating in the hot-rolling process, thereby possibly deteriorating the delayed fracture resistance. Accordingly, the Zr content is preferably 0.2% or less. The Zr content is more preferably 0.15% or less, even more preferably 0.10% or less.

W: 0.005% or More and 0.2% or Less

W is an element that contributes to an increase in strength and an improvement in delayed fracture resistance through the formation of fine W-based carbide and carbonitride particles serving as hydrogen-trapping sites. The W content is preferably 0.005% or more. The W content is more preferably 0.008% or more, even more preferably 0.010% or more. A W content of more than 0.2% may result in the increase of coarse precipitates that remain undissolved during slab heating in the hot-rolling process, thereby possibly deteriorating the delayed fracture resistance. Accordingly, the W content is preferably 0.2% or less. The W content is more preferably 0.15% or less, even more preferably 0.10% or less.

The steel sheet according to the embodiment may further contain one or more selected from elements described below, as needed.

Sb: 0.002% or More and 0.1% or Less

Sb is an element that suppresses the oxidation and nitridation of the surface layer and thereby suppresses the reductions of the amounts of C and B contained in the surface layer. The suppression of the reductions of the amounts of C and B contained inhibits the formation of ferrite in the surface layer to increase the strength and improve the delayed fracture resistance of the steel sheet. The Sb content is preferably 0.002% or more. The Sb content is more preferably 0.004% or more, even more preferably 0.006% or more. An Sb content of more than 0.1% may result in a deterioration in castability and may result in segregation of Sb at the grain boundaries of prior austenite to deteriorate the delayed fracture resistance. Accordingly, the Sb content is preferably 0.1% or less. The Sb content is more preferably 0.08% or less, even more preferably 0.04% or less.

Sn: 0.002% or More and 0.1% or Less

Sn is an element that suppresses the oxidation and nitridation of the surface layer and thereby suppresses the reductions of the amounts of C and B contained in the surface layer. The suppression of the reductions of the amounts of C and B contained inhibits the formation of ferrite in the surface layer to increase the strength and improve the delayed fracture resistance. The Sn content is preferably 0.002% or more. The Sn content is more preferably 0.004% or more, even more preferably 0.006% or more. A Sn content of more than 0.1% may result in a deterioration in castability and may result in segregation of Sn at the grain boundaries of prior austenite to deteriorate the delayed fracture resistance. Accordingly, the Sn content is preferably 0.1% or less. The Sn content is more preferably 0.08% or less, even more preferably 0.04% or less.

The steel sheet according to the embodiment may further contain one or more selected from elements described below, as needed.

Ca: 0.0002% or More and 0.0050% or Less

Ca is an element that immobilizes S in the form of CaS to improve the delayed fracture resistance. The Ca content is preferably 0.0002% or more. The Ca content is more preferably 0.0006% or more, even more preferably 0.0010% or more. A Ca content of more than 0.0050% may result in deteriorations in surface quality and bendability. Accordingly, the Ca content is preferably 0.0050% or less. The Ca content is more preferably 0.0045% or less, even more preferably 0.0035% or less.

Mg: 0.0002% or More and 0.01% or Less

Mg is an element that immobilizes O in the form of MgO to improve the delayed fracture resistance. The Mg content is preferably 0.0002% or more. The Mg content is more preferably 0.0004% or more, even more preferably 0.0006% or more. A Mg content of more than 0.01% may result in deteriorations in surface quality and bendability. Accordingly, the Mg content is preferably 0.01% or less. The Mg content is more preferably 0.008% or less, even more preferably 0.006% or less.

REM: 0.0002% or More and 0.01% or Less

A REM is an element that improves the bendability and the delayed fracture resistance by reducing the size of inclusions and reducing the starting points of fracture. The REM content is preferably 0.0002% or more. The REM content is more preferably 0.0004% or more, even more preferably 0.0006% or more. A REM content of more than 0.01% results in, on the contrary, the coarsening of inclusions to deteriorate the bendability and the delayed fracture resistance. Accordingly, the REM content is preferably 0.01% or less. The REM content is more preferably 0.008% or less, even more preferably 0.006% or less.

The steel sheet according to the embodiment has the foregoing component composition. The balance other than the foregoing component composition contains Fe (iron) and incidental impurities. The balance is preferably Fe and incidental impurities.

The microstructure of the steel sheet according to the embodiment will be described below. In the microstructure of the steel sheet according to the embodiment, the total area fraction of martensite and bainite is 95% or more and 100% or less. The balance is one or more selected from ferrite and retained austenite. Inclusion particles having a long-axis length of 20 μm or more and 80 μm or less and a minimum interparticle distance of more than 10 μm and inclusion particle clusters each having a long-axis cluster length of 20 μm or more and 80 μm or less and each including two or more inclusion particles having a long-axis length of 0.3 μm or more and a minimum interparticle distance of 10 μm or less have a density of 5 pieces/mm$^2$ or less.

Total Area Fraction of Martensite and Bainite: 95% or More and 100% or Less

Balance: One or More Selected from Ferrite and Retained Austenite

To obtain both of high strength, i.e., TS 1,320 MPa, and excellent delayed fracture resistance, the total area fraction of martensite and bainite needs to be 95% or more. The total area fraction of martensite and bainite is preferably 97% or more, more preferably 99% or more. When the total area fraction of martensite and bainite is less than this, the amount of one of ferrite and retained austenite is increased to deteriorate the delayed fracture resistance. The balance, which has an area fraction of 5% or less, other than martensite or bainite is one or more selected from ferrite and retained austenite. A portion other than these microstructures contains trace amounts of carbides, sulfides, nitrides, and oxides. The martensite also includes martensite that has not been tempered by holding at about 150° C. or higher for a certain period of time, including self-tempering during continuous cooling. The total area fraction of martensite and bainite may be 100% without including the balance. Martensite may be 100% (bainite: 0%), or bainite may be 100% (martensite: 0%).

Moreover, inclusion particles having a long-axis length of 20 μm or more and 80 μm or less and a minimum interparticle distance of more than 10 μm and inclusion particle clusters each having a long-axis cluster length of 20 μm or more and 80 μm or less and each including two or more inclusion particles having a long-axis length of 0.3 μm or more and a minimum interparticle distance of 10 μm or less need to have a density of 5 pieces/mm$^2$ or less. The reason for focusing attention on inclusion particles having a long-axis length of 0.3 μm or more is that inclusions having a long-axis length of less than 0.3 μm do not deteriorate the delayed fracture resistance even when they aggregate. The long-axis length of each of the inclusion particles refers to the length of each inclusion particle in the rolling direction.

The inclusions and the inclusion clusters are defined as described above; thus, inclusions and inclusion clusters that affect the delayed fracture resistance can be appropriately expressed. Adjustment of the number of the inclusion clusters defined as above per unit area (mm$^2$) enables an improvement in the delayed fracture resistance of the steel sheet. An inclusion particle present in a sector region having a center point located at an end portion of an inclusion in the longitudinal direction and having two radii that form an angle of ±10° with respect to the rolling direction has an effect on the delayed fracture resistance; thus, targets for the measurement of the minimum distance are inclusion particles present in the region (when part of an inclusion particle or part of an inclusion particle cluster specified in the disclosed embodiments is included in the region, it is targeted). The minimum interparticle distance refers to the minimum distance between points on the circumferences of the particles.

The shape and state of the inclusion particles included in the inclusion clusters are not particularly limited. The inclusion particles of the steel sheet according to the embodiment are usually inclusion particles elongating in the rolling direction or inclusions particles distributed in a sequence of dots in the rolling direction. Here, the phrase "inclusions distributed in a sequence of dots in the rolling direction" refers to inclusion particles including two or more inclusion particles distributed in sequence of dots in the rolling direction. To improve the delayed fracture resistance, the inclusion clusters composed of MnS, oxides, and nitrides need to be sufficiently reduced in a region extending from the surface layer to the center of the steel sheet in the thickness direction. In a component formed of a high-strength steel having TS 1,320 MPa, the distribution density of the inclusion clusters needs to be 5 pieces/mm$^2$ or less. This can suppress the occurrence of cracking from a sheared edge surface of the steel sheet according to the embodiment.

In the case where the long-axis length of inclusions and the long-axis cluster length of inclusion clusters are each less than 20 μm, the inclusions and the inclusion clusters have almost no effect on the delayed fracture resistance; thus, we need not pay attention thereto. Inclusions having a long-axis length of more than 80 μm and inclusion clusters having a long-axis cluster length of more than 80 μm are rarely formed at a S content of less than 0.0010%; thus, we do not have to pay attention thereto.

Local P Concentration in Region Extending from Position 1/4 of Thickness of Steel Sheet in the Thickness Direction to Position 3/4 of the Thickness of the Steel Sheet in the Thickness Direction: 0.060% or Less by Mass Degree of Mn Segregation in Region Extending from Position 1/4 of Thickness of Steel Sheet in the Thickness Direction to Position 3/4 of the Thickness of the Steel Sheet in the Thickness Direction: 1.50 or Less Regarding the microstructure of the steel sheet according to the embodiment, in order to suppress the delayed fracture that occurs at a sheared edge surface itself, it is necessary to achieve a local P concentration of 0.060% or less by mass in a region extending from a position 1/4 of the thickness of the steel sheet in the thickness direction to a position 3/4 of the thickness of the steel sheet in the thickness direction and a degree of Mn segregation of 1.50 or less in the region extending from the position 1/4 of the thickness of the steel sheet in the thickness direction to the position 3/4 of the thickness of the steel sheet in the thickness direction. In the embodiment, the term "local P concentration" refers to a P concentration in a P-rich region at a cross-section of the sheet parallel to the rolling direction of the steel sheet. Usually, the P-rich region has an elongated distribution in the rolling direction and is often found at or near the center of the steel sheet in the thickness direction because of solidification segregation occurring during casting molten steel. The P-rich region is in a state in which the grain boundary strength of the steel is significantly decreased and the delayed fracture resistance is deteriorated. The delayed fracture that occurs at the sheared edge surface itself starts from the vicinity of the center of the steel sheet in the thickness direction of the sheared edge surface, and the fracture exhibits intergranular fracture. Thus, a reduction in P concentration at the center of the steel sheet in the thickness direction is important for suppressing delayed fracture that occurs at the sheared edge surface itself.

Regarding the measurement of the P concentration in the P-rich region, the P concentration distribution in the region extending from the position 1/4 of the thickness of the steel sheet in the thickness direction to the position 3/4 of the thickness of the steel sheet in the thickness direction of the cross-section of the steel sheet parallel to the rolling direction is measured with an electron probe micro analyzer (EPMA). The maximum P concentration varies depending on the measurement conditions of the EPMA. For this reason, in the embodiment, the evaluation is performed in 10 measurement fields of view under fixed conditions: an acceleration voltage of 15 kV, a beam current of 2.5 μA, an acquisition time of 0.02 s/point, a probe diameter of 1 μm, and a measurement pitch of 1 μm.

Regarding the quantification of the local P concentration, in order to evaluate the local P concentration excluding variations in P concentration, data processing is performed as follows: In the P concentration distribution measured with the EPMA, the average P concentration in a region of 1 μm in the thickness direction and 50 μm in the rolling direction is calculated to obtain the line profile of the average P concentration of the steel sheet in the thickness direction. The maximum P concentration in this line profile is defined as a local P concentration in the field of view. The same process is performed at randomly selected 10 fields of view to obtain the maximum value of the local P concentration. Here, the size of the region for averaging the P concentration is determined as follows: Because the thickness of the P-rich region is as thin as several micrometers, the averaging range in the thickness direction is 1 μm in order to obtain sufficient resolution. The averaging range in the rolling direction is preferably as long as possible; however, an averaging range of more than 50 μm result in a manifestation of the effect of variations in P concentration in the thickness direction. For this reason, the averaging range in the rolling direction was set to 50 μm. By setting the averaging range in the rolling direction to 50 μm, it is possible to determine the representativeness of variations in the P-rich region.

At a higher local P concentration, the steel sheet tends to have higher brittleness. A local P concentration of more than 0.060% by mass is more likely to cause delayed fracture at a sheared edge surface itself. Accordingly, the local P concentration needs to be 0.060% or less by mass. The local P concentration is preferably 0.040% or less by mass, more preferably 0.030% or less by mass. A lower local P concentration is more preferred; thus, the lower limit thereof need not be specified. Practically, the local P concentration is often 0.010% or more by mass.

The degree of Mn segregation in the embodiment refers to the ratio of the local Mn concentration to the average Mn concentration in a cross-section of the steel sheet parallel to the rolling direction. As with P, Mn is an element that segregates easily at or near the center of the steel sheet in the thickness direction. The Mn-rich portion in which Mn segregates deteriorates the delayed fracture properties at the sheared edge surface itself through the formation of inclusions mainly composed of MnS and an increase in material strength.

The Mn concentration is measured with the EPMA under the same measurement conditions as those for the P concentration. The presence of inclusions such as MnS increases an apparent maximum degree of Mn segregation. Thus, if inclusions are present, the value thereof is excluded from the evaluation. In the Mn concentration distribution measured with the EPMA, the average Mn concentration in a region of 1 μm in the thickness direction and 50 μm in the rolling direction is calculated to obtain the line profile of the average Mn concentration of the steel sheet in the thickness direction. The average value of the line profile is defined as the average Mn concentration, the maximum value is defined as the local Mn concentration, and the ratio of the local Mn concentration to the average Mn concentration is defined as the degree of Mn segregation.

A degree of Mn segregation of more than 1.50 is more likely to cause delayed fracture at the sheared edge surface itself. Accordingly, the degree of Mn segregation needs to be 1.50 or less. The degree of Mn segregation is preferably 1.30 or less, more preferably 1.25 or less. A lower degree of Mn segregation is more preferred; the lower limit of the degree of Mn segregation need not be specified. Practically, the degree of Mn segregation is often 1.00 or more.

Tensile Strength (TS): 1,320 MPa or More

A deterioration in delayed fracture resistance is significantly manifested when a steel sheet has a tensile strength of 1,320 MPa or more. One of the features of the steel sheet according to the embodiment is that the steel sheet has good delayed fracture resistance even when it has a tensile strength of 1,320 MPa or more. Thus, the steel sheet according to the embodiment has a tensile strength of 1,320 MPa or more.

The steel sheet according to the embodiment may have a coated layer on its surface. The type of coated layer is not limited, and may be either a Zn-coated layer or a coated layer of a metal other than Zn. The coated layer may contain a component other than a main component, such as Zn. The zinc-coated layer is, for example, a hot-dip galvanized layer or an electrogalvanized layer. The hot-dip galvanized layer may be a hot-dip galvannealed layer, which is an alloyed layer.

A method for producing the steel sheet according to the embodiment will be described below. The steel sheet according to the embodiment is produced by performing continuous casting of a slab from a molten steel having the foregoing component composition at a difference between a casting temperature and a solidification temperature of 10° C. or higher and 40° C. or lower, the continuous casting including cooling the slab at a specific water flow of 0.5 L/kg or more and 2.5 L/kg or less until the temperature of a surface layer portion of a solidifying shell reaches 900° C. in a secondary cooling zone, and passing the slab having a temperature of 600° C. or higher and 1,100° C. or lower through a bending zone and a straightening zone; directly or after temporary cooling, holding a surface temperature of the slab at 1,220° C. or higher for 30 minutes or more, then hot-rolling the slab into a hot-rolled steel sheet, cold-rolling the hot-rolled steel sheet at a cold rolling reduction rate of 40% or more into a cold-rolled steel sheet; and performing continuous annealing of the cold-rolled steel sheet, the continuous annealing including subjecting the cold-rolled steel sheet to soaking treatment at 800° C. or higher for 240 seconds or more, cooling the steel sheet from a temperature of 680° C. or higher to a temperature of 260° C. or lower at an average cooling rate of 70° C./s or more, reheating the steel sheet as needed, and then holding the steel sheet in a temperature range of 150° C. to 260° C. for 20 to 1,500 seconds.

Continuous Casting

In casting of the slab from the molten steel, a circular-arc type, vertical type, or vertical-bending type continuous caster is preferably used in order to achieve both of the control of unevenness in concentration in the width direction and the productivity. In the steel sheet according to the embodiment, in order to obtain the predetermined local P concentration and degree of Mn segregation, it is important not only to limit the amounts of P and Mn, but also to control the casting temperature and spray cooling in the region from directly below the mold to a position at which the solidification is completed in the secondary cooling during the casting.

Difference between Casting Temperature and Solidification Temperature: 10° C. or Higher and 40° C. or Lower A reduction in the difference between the casting temperature and the solidification temperature promotes the formation of equiaxed crystals during solidification to reduce the segregation of, for example, P and Mn. To sufficiently provide this effect, the difference between the casting temperature and the solidification temperature needs to be 40° C. or lower. The difference between the casting temperature and the solidification temperature is preferably 35° C. or lower, more preferably 30° C. or lower. When the difference between the casting temperature and the solidification temperature is lower than 10° C., defects due to entrapment of, for example, powder and slag, during casting may increase disadvantageously. Accordingly, the difference between the casting temperature and the solidification temperature needs to be 10° C. or higher. The difference between the casting temperature and the solidification temperature is preferably 15° C. or higher, more preferably 20° C. or higher. The casting temperature can be determined by actual measurement of the temperature of the molten steel in a tundish. The solidification temperature can be determined by actual measurement of the component composition of the steel and using formula (3) below.

$$\text{Solidification temperature}(^\circ\text{C.}) = 1539 - (70\times[\%\text{C}] + 8\times[\%\text{Si}] + 5\times[\%\text{Mn}] + 30\times[\%\text{P}] + 25\times[\%\text{S}] + 5\times[\%\text{Cu}] + 4\times[\%\text{Ni}] + 1.5\times[\%\text{Cr}]) \quad (3)$$

In formula (3), [% C], [% Si], [% Mn], [% P], [% S], [% Cu], [% Ni], and [% Cr] each indicate the amount of the corresponding element contained in steel (% by mass).

Specific Water Flow Until Temperature of Surface Layer Portion of Solidifying Shell in Secondary Cooling Zone Reaches 900° C.: 0.5 L/kg or More and 2.5 L/kg or Less When the specific water flow until the temperature of the surface layer portion of the solidifying shell reaches 900° C. is more than 2.5 L/kg, the corner portions of the cast slab are extremely overcooled, and tensile stress is caused by a difference in thermal expansion between the corner portions and the surrounding high-temperature portion and acts to increase transverse cracking. Accordingly, the specific water flow until the temperature of the surface layer portion of the solidifying shell reaches 900° C. needs to be 2.5 L/kg or less. The specific water flow until the temperature of the surface layer portion of the solidifying shell reaches 900° C. is preferably 2.2 L/kg or less, more preferably 1.8 L/kg or less. When the specific water flow until the temperature of the surface layer portion of the solidifying shell reaches 900° C. is less than 0.5 L/kg, the local P concentration and the degree of Mn segregation are increased. Accordingly, the specific water flow until the temperature of the surface layer portion of the solidifying shell reaches 900° C. needs to be 0.5 L/kg or more. The specific water flow until the temperature of the surface layer portion of the solidifying shell reaches 900° C. is preferably 0.8 L/kg or more, more preferably 1.0 L/kg or more. The term "surface layer portion of the solidifying shell" used here indicates a region extending from the surface of the slab to a depth of 2 mm in an area extending from each of the corner portions of the slab to a corresponding one of the positions 150 mm from the corner portions in the width direction. The specific water flow is calculated from formula (4) below.

$$P = Q/(W \times Vc) \quad (4)$$

In formula (4), P is a specific water flow (L/kg), Q is a cooling water flow rate (L/min), W is a slab unit weight (kg/m), and Vc is a casting speed (m/min).

Temperature during Passage through Bending Zone and Straightening Zone: 600° C. or Higher and 1,100° C. or Lower When the temperature during passage through the bending zone and the straightening zone is 1,100° C. or lower, centerline segregation is reduced to suppress the delayed fracture that occurs at the sheared edge surface itself through the suppression of the bulging of the cast slab. When the temperature during passage through the bending zone and the straightening zone is more than 1,100° C., the effects described above are reduced. Additionally, coarse inclusions containing Nb and Ti may precipitate to have an adverse effect as inclusions. Accordingly, the temperature during passage through the bending zone and the straightening zone needs to be 1,100° C. or lower. The temperature during passage through the bending zone and the straightening zone is preferably 950° C. or lower, more preferably 900° C. or lower. When the temperature during passage through the bending zone and the straightening zone is lower than 600° C., the cast slab is hardened to increase the deformation load of a bending straightener, thereby shortening the life of rolls in the straightening zone. Soft reduction by a reduction in roll gap at the final stage of solidification does not sufficiently work, thereby deteriorating the centerline segregation. Accordingly, the temperature during passage through the bending zone and the straightening zone needs to be 600° C. or higher. The temperature during passage through the bending zone and the straightening zone section is preferably 650° C. or higher, more preferably 700° C. or higher. The temperature during passage through the bending zone and the straightening zone refers to the surface temperature of the central portion of the width of the slab passing through the bending zone and the straightening zone.

Hot Rolling

Examples of a method for hot-rolling a steel slab include a method in which a slab is heated and then hot-rolled, a method in which a slab formed by continuous casting is directly rolled without being heated, and a method in which a slab formed by continuous casting is subjected to heat treatment for a short time and then rolling. Regarding the method for producing the steel sheet according to the embodiment, the slab is hot-rolled by any of these methods.

Slab Surface Temperature: 1,220° C. or Higher Holding Time: 30 Minutes or More

To promote the dissolution of sulfides and reduce the size and the number of inclusion clusters, during the hot rolling, the slab surface temperature needs to be 1,220° C. or higher, and the holding time needs to be 30 minutes or more. This provides the above-described effects and reduces the segregation of P and Mn. The slab surface temperature is preferably 1,250° C. or higher, more preferably 1,280° C. or higher. The holding time is preferably 35 minutes or more, more preferably 40 minutes or more. The average heating rate during slab heating may be 5 to 15° C./min, the finish rolling temperature FT may be 840° C. to 950° C., and the coiling temperature CT may be 400° C. to 700° C., as in the usual manner.

To remove primary scale and secondary scale formed on the surface of the steel sheet, descaling may be appropriately performed. Preferably, the hot-rolled coil is sufficiently pickled to reduce the amount of remaining scale before the cold rolling. From the viewpoint of reducing the load required for cold rolling, the hot-rolled steel sheet may be subjected to annealing, as needed. Each temperature of the steel sheet in the following method for producing the steel sheet is the surface temperature of the steel sheet.

Cold Rolling

Cold Rolling Reduction Rate: 40% or More

When the rolling reduction rate in the cold rolling (cold rolling reduction rate) is 40% or more, it is possible to stabilize the recrystallization behavior and the orientation of the texture in the subsequent continuous annealing. A cold rolling reduction rate of less than 40% may result in coarsening of some austenite grains during annealing to decrease the strength of the steel sheet. Accordingly, the cold rolling reduction rate needs to be 40% or more. The cold rolling reduction rate is preferably 45% or more, more preferably 50% or more.

Continuous Annealing

Annealing Temperature: 800° C. or Higher

Soaking Time: 240 Seconds or More

The cold-rolled steel sheet is subjected to annealing in a continuous annealing line (CAL) and, if necessary, tempering treatment and temper rolling. To obtain predetermined martensite or bainite in the embodiment, the annealing temperature needs to be 800° C. or higher, and the soaking time needs to be 240 seconds or more. The annealing temperature is preferably 820° C. or higher, more preferably 840° C. or higher. The soaking time is preferably 300 seconds or more, more preferably 360 seconds or more. An annealing temperature of lower than 800° C. or a short soaking time results in a failure to sufficiently form austenite. In the final product, thus, predetermined martensite or bainite is not obtained, and a tensile strength of 1,320 MPa or more is not obtained. The upper limits of the annealing temperature and the soaking time need not be specified. When the annealing temperature or the soaking time exceeds a certain level, the austenite grain size may be increased to deteriorate the toughness. Accordingly, the annealing temperature is preferably 950° C. or lower, more preferably 920° C. or lower. The soaking time is preferably 900 seconds or less, more preferably 720 seconds or less.

Average Cooling Rate from Temperature of 680° C. or Higher to Temperature of 260° C. or Lower: 70° C./s or More To reduce ferrite and retained austenite and achieve a total area fraction of martensite and bainite of 95% or more, the average cooling rate from a temperature of 680° C. or higher to a temperature of 260° C. or lower needs to be 70° C./s or more. The average cooling rate from a temperature of 680° C. or higher to a temperature of 260° C. or lower is preferably 150° C./s or more, more preferably 300° C./s or more. A cooling start temperature of lower than 680° C. results in the formation of a large amount of ferrite and the concentration of carbon in austenite to lower the Ms temperature, thereby increasing the amount of martensite (fresh martensite) that is not tempered. An average cooling rate of less than 70° C./s or a cooling stop temperature of higher than 260° C. results in the formation of upper bainite and lower bainite to increase the amounts of retained austenite and fresh martensite. Fresh martensite in martensite can be tolerated up to 5% when martensite is 100 in terms of area fraction. When the above-described continuous annealing conditions are used, the area fraction of fresh martensite is 5% or less. The average cooling rate is calculated by dividing the temperature difference between a cooling start temperature of 680° C. or higher and a cooling stop temperature of 260° C. or lower by the time required for the cooling from the cooling start temperature to the cooling stop temperature.

Holding Time in Temperature Range of 150° C. to 260° C.: 20 to 1,500 Seconds

Carbide distributed in martensite or bainite is carbide formed during holding in a low temperature range after quenching. To ensure high delayed fracture resistance and TS 1,320 MPa, the formation of the carbide needs to be appropriately controlled. Specifically, the temperature at which the steel sheet is reheated and held after cooling to near room temperature or the cooling stop temperature after quenching needs to be 150° C. or higher and 260° C. or lower, and the holding time at a temperature of 150° C. or higher and 260° C. or lower needs to be 20 seconds or more and 1,500 seconds or less. The holding time at a temperature of 150° C. or higher and 260° C. or lower is preferably 60 seconds or more, more preferably 300 seconds or more. The holding time at a temperature of 150° C. or higher and 260° C. or lower is preferably 1,320 seconds or less, more preferably 1,200 seconds or less.

A cooling stop temperature of lower than 150° C. or a holding time of less than 20 seconds leads to insufficient control of the formation of carbide inside the transformation phase to deteriorate the delayed fracture resistance. A cooling stop temperature of higher than 260° C. may result in coarsening of carbide in grains and at block grain boundaries to deteriorate the delayed fracture resistance. A holding time of more than 1,500 seconds results in the saturation of the formation and growth of carbide and an increase in production cost.

The steel sheet produced in this way may be subjected to skin pass rolling from the viewpoint of stabilizing the press formability by, for example, adjusting the surface roughness and flattening the sheet shape. In this case, the skin-pass elongation is preferably 0.1% to 0.6%. In this case, the skin pass roll is a dull roll, and the roughness Ra of the steel sheet is preferably adjusted to 0.3 to 1.8 μm from the viewpoint of shape flattening.

The produced steel sheet may be subjected to coating treatment. The coating treatment provides a steel sheet including a coated layer on its surface. The type of coating treatment is not particularly limited and may be either hot-dip coating or electroplating. Additionally, after the hot-dip coating, coating treatment for alloying may be performed. In the case of performing coating treatment, when the above skin pass rolling is performed, the skin pass rolling is preferably performed after the coating treatment.

The production of the steel sheet according to the embodiment may be performed in a continuous annealing line or offline.

A member according to the embodiment is a member obtained by subjecting the steel sheet according to the embodiment to at least one of forming and welding. A method for producing a member according to the embodiment includes a step of subjecting a steel sheet produced by the method for producing a steel sheet according to the embodiment to at least one of forming and welding. The member according to the embodiment has excellent delayed fracture properties at a sheared edge surface itself and thus has high structural reliability as a member. For the forming, general processing methods, such as press forming, can be employed without limitation. For the welding, general welding methods, such as spot welding and arc welding, can be employed without limitation. The member according to the embodiment can be suitably used for automotive components.

EXAMPLES

Example 1

The disclosed embodiments will be specifically described below by examples. Molten steels having compositions given in Table 1 were produced and cast into slabs under the following conditions as given in Table 2: the difference between the casting temperature and the solidification temperature was 10° C. or higher and 40° C. or lower, a specific water flow was 0.5 L/kg or more and 2.5 L/kg or less until the temperature of the surface layer portion of the solidifying shell in a secondary cooling zone reached 900° C., and the temperature (T) during passage through a bending zone and a straightening zone was 600° C. to 1,100° C. In the column "[% Ti]×[% Nb]$^2$" in Table 1, "E-numeral" refers to 10 to the power of −numeral. For example, E-07 refers to $10^{-7}$.

TABLE 1

| Steel No. | Component Composition (% by mass) | | | | | | | | | | | | | | |
|---|---|---|---|---|---|---|---|---|---|---|---|---|---|---|---|
| | C | Si | Mn | P | S | sol.Al | N | 0 | B | Nb | Ti | [% Ti] + [% Nb] | [% Ti] × [% Nb]$^2$ | others | Remarks |
| A | 0.14 | 1.0 | 1.1 | 0.008 | 0.0016 | 0.026 | 0.0029 | 0.0011 | 0.0022 | 0.010 | 0.022 | 0.032 | 2.2E−06 | — | Conforming steel |
| B | 0.39 | 0.4 | 0.9 | 0.006 | 0.0010 | 0.044 | 0.0028 | 0.0011 | 0.0024 | 0.012 | 0.024 | 0.036 | 3.5E−06 | — | Conforming steel |
| C | 0.15 | 1.4 | 1.0 | 0.007 | 0.0012 | 0.025 | 0.0050 | 0.0014 | 0.0013 | 0.008 | 0.030 | 0.038 | 1.9E−06 | — | Conforming steel |
| D | 0.18 | 0.8 | 1.6 | 0.006 | 0.0014 | 0.038 | 0.0033 | 0.0008 | 0.0015 | 0.009 | 0.019 | 0.028 | 1.5E−06 | — | Conforming steel |
| E | 0.23 | 0.6 | 1.2 | 0.010 | 0.0008 | 0.037 | 0.0045 | 0.0009 | 0.0017 | 0.013 | 0.018 | 0.031 | 3.0E−06 | — | Conforming steel |
| F | 0.25 | 0.7 | 1.1 | 0.005 | 0.0019 | 0.021 | 0.0046 | 0.0010 | 0.0026 | 0.011 | 0.023 | 0.034 | 2.8E−06 | — | Conforming steel |
| G | 0.30 | 0.2 | 1.2 | 0.003 | 0.0003 | 0.039 | 0.0051 | 0.0008 | 0.0021 | 0.010 | 0.022 | 0.032 | 2.2E−06 | — | Conforming steel |
| H | 0.31 | 0.1 | 1.3 | 0.005 | 0.0009 | 0.000 | 0.0045 | 0.0020 | 0.0034 | 0.013 | 0.021 | 0.034 | 3.5E−06 | — | Conforming steel |
| I | 0.33 | 0.3 | 1.5 | 0.006 | 0.0007 | 0.030 | 0.0042 | 0.0015 | 0.0003 | 0.012 | 0.018 | 0.030 | 2.6E−06 | — | Conforming steel |
| J | 0.30 | 0.5 | 0.7 | 0.005 | 0.0008 | 0.026 | 0.0031 | 0.0011 | 0.0015 | 0.034 | 0.005 | 0.039 | 5.8E−06 | — | Conforming steel |
| K | 0.21 | 0.4 | 0.6 | 0.008 | 0.0012 | 0.002 | 0.0017 | 0.0012 | 0.0020 | 0.003 | 0.013 | 0.016 | 1.2E−07 | — | Conforming steel |
| L | 0.20 | 0.5 | 0.5 | 0.008 | 0.0011 | 0.012 | 0.0019 | 0.0019 | 0.0021 | 0.005 | 0.080 | 0.085 | 2.0E−06 | — | Conforming steel |
| M | 0.23 | 1.2 | 0.6 | 0.007 | 0.0010 | 0.051 | 0.0046 | 0.0008 | 0.0022 | 0.023 | 0.005 | 0.028 | 2.6E−06 | — | Conforming steel |
| N | 0.19 | 1.3 | 0.9 | 0.006 | 0.0005 | 0.054 | 0.0041 | 0.0014 | 0.0021 | 0.018 | 0.018 | 0.036 | 5.8E−06 | Cu:0.12, Ni:0.05 | Conforming steel |
| O | 0.22 | 1.1 | 0.9 | 0.006 | 0.0006 | 0.041 | 0.0037 | 0.0014 | 0.0025 | 0.020 | 0.014 | 0.034 | 5.6E−06 | Cu:0.20,Ni:0.14 | Conforming steel |
| P | 0.26 | 1.2 | 1.0 | 0.008 | 0.0008 | 0.036 | 0.0029 | 0.0011 | 0.0031 | 0.030 | 0.007 | 0.037 | 6.3E−06 | Cr:0.03,Mo:0.02, V:0.008 | Conforming steel |
| Q | 0.28 | 0.9 | 1.0 | 0.006 | 0.0010 | 0.040 | 0.0035 | 0.0016 | 0.0008 | 0.012 | 0.023 | 0.035 | 3.3E−06 | Cr:0.04, V:0.005, Zr:0.004 | Conforming steel |
| R | 0.27 | 0.7 | 1.2 | 0.005 | 0.0011 | 0.029 | 0.0046 | 0.0008 | 0.0021 | 0.013 | 0.025 | 0.038 | 4.2E−06 | V:0.005,W:0.008 | Conforming steel |
| S | 0.25 | 0.8 | 0.9 | 0.006 | 0.0008 | 0.026 | 0.0040 | 0.0017 | 0.0015 | 0.010 | 0.020 | 0.030 | 2.0E−06 | Sb:0.008 | Conforming steel |
| T | 0.26 | 0.8 | 1.0 | 0.007 | 0.0006 | 0.031 | 0.0030 | 0.0009 | 0.0023 | 0.015 | 0.002 | 0.017 | 4.5E−07 | Sb0.010,Sn:0.005 | Conforming steel |
| U | 0.16 | 0.8 | 1.2 | 0.006 | 0.0007 | 0.031 | 0.0023 | 0.0008 | 0.0017 | 0.005 | 0.051 | 0.056 | 1.3E−06 | Ca:0.0030, Mg:0.0008 | Conforming steel |
| V | 0.17 | 0.2 | 1.1 | 0.005 | 0.0005 | 0.035 | 0.0043 | 0.0008 | 0.0013 | 0.007 | 0.052 | 0.059 | 2.5E−06 | Mg:0.0005, REM:0.0003 | Conforming steel |
| W | 0.18 | 0.1 | 1.1 | 0.004 | 0.0005 | 0.032 | 0.0039 | 0.0000 | 0.0022 | 0.007 | 0.050 | 0.057 | 2.5E−06 | Cu:0.11,Cr:0.03, Sb:0.01 | Conforming steel |
| X | 0.19 | 0.2 | 1.2 | 0.007 | 0.0010 | 0.041 | 0.0050 | 0.0010 | 0.0009 | 0.014 | 0.020 | 0.034 | 3.9E−06 | — | Conforming steel |
| Y | 0.12 | 0.8 | 1.0 | 0.008 | 0.0010 | 0.032 | 0.0039 | 0.0019 | 0.0024 | 0.020 | 0.018 | 0.038 | 7.2E−06 | — | Comparative steel |
| Z | 0.42 | 0.3 | 1.4 | 0.007 | 0.0016 | 0.017 | 0.0052 | 0.0011 | 0.0018 | 0.015 | 0.030 | 0.045 | 6.8E−06 | — | Comparative steel |
| AA | 0.18 | 1.6 | 1.3 | 0.006 | 0.0012 | 0.052 | 0.0040 | 0.0012 | 0.0021 | 0.010 | 0.024 | 0.034 | 2.4E−06 | — | Comparative steel |
| AB | 0.21 | 0.6 | 1.2 | 0.013 | 0.0013 | 0.019 | 0.0037 | 0.0011 | 0.0015 | 0.012 | 0.023 | 0.035 | 3.3E−06 | — | Comparative steel |
| AC | 0.23 | 0.5 | 1.0 | 0.009 | 0.0023 | 0.041 | 0.0034 | 0.0015 | 0.0013 | 0.012 | 0.002 | 0.014 | 3.0E−07 | — | Comparative steel |
| AD | 0.26 | 0.4 | 1.1 | 0.006 | 0.0016 | 0.205 | 0.0034 | 0.0012 | 0.0022 | 0.010 | 0.022 | 0.032 | 2.2E−06 | — | Comparative steel |
| AE | 0.25 | 0.8 | 1.0 | 0.008 | 0.0015 | 0.040 | 0.0058 | 0.0022 | 0.0015 | 0.008 | 0.020 | 0.028 | 1.3E−06 | — | Comparative steel |
| AF | 0.34 | 1.0 | 0.6 | 0.007 | 0.0012 | 0.048 | 0.0052 | 0.0028 | 0.0014 | 0.009 | 0.016 | 0.025 | 1.3E−06 | — | Comparative steel |
| AG | 0.33 | 0.1 | 0.7 | 0.006 | 0.0011 | 0.043 | 0.0051 | 0.0012 | 0.0037 | 0.010 | 0.018 | 0.028 | 1.8E−06 | — | Comparative steel |
| AH | 0.15 | 0.2 | 0.8 | 0.006 | 0.0008 | 0.050 | 0.0033 | 0.0009 | 0.0016 | 0.001 | 0.018 | 0.019 | 1.8E−08 | — | Comparative steel |
| AI | 0.14 | 0.4 | 1.4 | 0.009 | 0.0009 | 0.029 | 0.0036 | 0.0004 | 0.0024 | 0.037 | 0.020 | 0.057 | 2.7E−05 | — | Comparative steel |
| AJ | 0.19 | 0.4 | 1.5 | 0.008 | 0.0007 | 0.046 | 0.0035 | 0.0004 | 0.0006 | 0.010 | 0.001 | 0.011 | 1.0E−07 | — | Comparative steel |
| AK | 0.19 | 0.9 | 1.4 | 0.006 | 0.0005 | 0.024 | 0.0031 | 0.0009 | 0.0014 | 0.015 | 0.104 | 0.119 | 2.3E−05 | — | Comparative steel |
| AL | 0.21 | 0.7 | 1.4 | 0.005 | 0.0012 | 0.033 | 0.0036 | 0.0011 | 0.0019 | 0.021 | 0.035 | 0.056 | 1.5E−05 | — | Comparative steel |
| AM | 0.22 | 0.5 | 1.2 | 0.005 | 0.0015 | 0.033 | 0.0046 | 0.0011 | 0.0018 | 0.003 | 0.003 | 0.006 | 2.7E−08 | — | Comparative steel |

Each of the slabs were heated to a slab reheating temperature (SRT) of 1,220° C. or higher, held for a holding time of 30 minutes or more, hot-rolled at a finish rolling temperature of 840° C. to 950° C., and coiled at a coiling temperature of 400° C. to 700° C., as given in Table 2. The resulting hot-rolled steel sheet was pickled and then cold-rolled at a rolling reduction rate of 40% or more into a cold-rolled steel sheet. The temperature represented as a slab reheating temperature is the surface temperature of the slab. The temperature of a surface layer portion of a solidifying shell is a slab surface temperature at a position 100 mm from a corner portion of the slab in the width direction.

In a continuous annealing step, the resulting cold-rolled steel sheets were subjected to soaking treatment at an annealing temperature of higher than 800° C. for 240 seconds or more, cooling from a temperature of 680° C. or higher to a temperature of 260° C. or lower at an average cooling rate of 70° C./s or more, and holding treatment in a temperature range of 150° C. to 260° C. for 20 to 1,500 seconds (some of the steel sheets were reheated and the others were held at a cooling stop temperature of 150° C. to 260° C.), as given in Table 2. Then temper rolling was performed at an elongation of 0.1%. Thereby, the steel sheets were produced.

TABLE 2

| | | Casting conditions | | | Hot-rolling conditions | | Cold-rolling conditions |
|---|---|---|---|---|---|---|---|
| No. | Steel No. | Difference between casting temperature and solidification temperature (° C.) | Specific water flow (L/kg) | Temperature during passage through bending zone and straightening zone (° C.) | SRT (° C.) | Heating time (min) | Rolling reduction rate (%) |
| 1 | A | 27 | 2.1 | 800 | 1230 | 80 | 60 |
| 2 | B | 26 | 2.1 | 800 | 1230 | 80 | 60 |
| 3 | C | 13 | 1.7 | 800 | 1230 | 80 | 60 |
| 4 | D | 31 | 1.9 | 850 | 1230 | 80 | 60 |
| 5 | E | 28 | 1.9 | 850 | 1260 | 40 | 50 |
| 6 | F | 30 | 1.5 | 850 | 1260 | 40 | 50 |
| 7 | G | 19 | 1.3 | 700 | 1260 | 40 | 50 |
| 8 | H | 41 | 1.6 | 700 | 1260 | 40 | 50 |
| 9 | I | 21 | 1.4 | 700 | 1280 | 30 | 40 |
| 10 | J | 32 | 0.9 | 900 | 1280 | 30 | 40 |
| 11 | K | 29 | 2.3 | 900 | 1280 | 110 | 60 |
| 12 | L | 33 | 1.3 | 900 | 1240 | 110 | 60 |
| 13 | M | 31 | 0.8 | 900 | 1240 | 110 | 60 |
| 14 | N | 29 | 1.5 | 650 | 1240 | 110 | 60 |
| 15 | O | 21 | 2.1 | 650 | 1250 | 110 | 60 |
| 16 | P | 15 | 1.9 | 650 | 1250 | 130 | 55 |
| 17 | Q | 22 | 1.5 | 650 | 1250 | 130 | 55 |
| 18 | R | 27 | 1.1 | 1000 | 1250 | 130 | 55 |
| 19 | S | 33 | 1.6 | 1000 | 1320 | 30 | 55 |
| 20 | T | 30 | 1.7 | 1000 | 1320 | 30 | 55 |
| 21 | U | 24 | 1.6 | 1000 | 1320 | 30 | 55 |
| 22 | V | 28 | 1.9 | 950 | 1230 | 110 | 45 |
| 23 | W | 29 | 1.5 | 950 | 1230 | 110 | 45 |
| 24 | X | 20 | 1.1 | 950 | 1230 | 110 | 45 |
| 25 | Y | 25 | 2.0 | 950 | 1260 | 110 | 60 |
| 26 | Z | 31 | 1.4 | 800 | 1260 | 110 | 60 |
| 27 | AA | 26 | 1.5 | 800 | 1260 | 110 | 60 |
| 28 | AB | 21 | 1.9 | 800 | 1280 | 110 | 60 |
| 29 | AC | 30 | 1.9 | 800 | 1280 | 110 | 60 |
| 30 | AD | 23 | 2.5 | 900 | 1240 | 110 | 60 |
| 31 | AE | 24 | 1.4 | 900 | 1240 | 110 | 60 |
| 32 | AF | 20 | 1.2 | 900 | 1240 | 40 | 55 |
| 33 | AG | 27 | 0.9 | 1050 | 1240 | 40 | 55 |
| 34 | AH | 33 | 0.8 | 1050 | 1270 | 40 | 55 |
| 35 | AI | 25 | 0.8 | 1050 | 1270 | 40 | 55 |
| 36 | AJ | 28 | 1.6 | 1050 | 1270 | 40 | 55 |
| 37 | AK | 23 | 2.5 | 750 | 1270 | 40 | 55 |
| 38 | AL | 20 | 1.6 | 750 | 1270 | 40 | 55 |
| 39 | AM | 31 | 1.7 | 750 | 1270 | 40 | 55 |
| 40 | E | 42 | 0.4 | 1100 | 1230 | 60 | 65 |
| 41 | E | 26 | 1.3 | 1150 | 1230 | 60 | 65 |
| 42 | E | 24 | 1.3 | 550 | 1230 | 60 | 65 |
| 43 | E | 28 | 2.1 | 950 | 1210 | 60 | 65 |
| 44 | E | 29 | 1.5 | 950 | 1250 | 20 | 65 |
| 45 | E | 29 | 0.9 | 950 | 1250 | 50 | 35 |
| 46 | E | 37 | 2.0 | 950 | 1250 | 50 | 50 |
| 47 | F | 20 | 1.4 | 900 | 1250 | 50 | 50 |
| 48 | F | 23 | 1.6 | 900 | 1260 | 70 | 50 |
| 49 | F | 28 | 1.4 | 900 | 1260 | 70 | 55 |
| 50 | F | 23 | 1.5 | 800 | 1260 | 70 | 55 |
| 51 | F | 24 | 1.7 | 800 | 1260 | 90 | 55 |
| 52 | G | 18 | 0.9 | 800 | 1260 | 90 | 60 |
| 53 | G | 31 | 1.0 | 800 | 1240 | 90 | 60 |
| 54 | G | 23 | 1.3 | 750 | 1240 | 90 | 60 |
| 55 | G | 14 | 1.5 | 750 | 1240 | 50 | 60 |
| 56 | H | 22 | 1.3 | 750 | 1240 | 50 | 60 |
| 57 | H | 28 | 2.1 | 750 | 1250 | 50 | 50 |
| 58 | H | 25 | 2.0 | 750 | 1250 | 50 | 50 |
| 59 | H | 33 | 2.3 | 750 | 1250 | 50 | 50 |

TABLE 2-continued

| No. | Steel No. | Annealing conditions: Annealing temperature (° C.) | Soaking time (s) | Cooling-start temperature (° C.) | Cooling rate (° C./s) | Cooling-stop temperature (° C.) | Holding temperature (° C.) | Holding time (sec) | Remarks |
|---|---|---|---|---|---|---|---|---|---|
| 1 | A | 890 | 390 | 760 | 813 | 30 | 190 | 780 | Conforming steel |
| 2 | B | 880 | 410 | 750 | 800 | 30 | 183 | 820 | Conforming steel |
| 3 | C | 930 | 300 | 800 | 867 | 30 | 224 | 600 | Conforming steel |
| 4 | D | 900 | 360 | 770 | 827 | 30 | 192 | 720 | Conforming steel |
| 5 | E | 880 | 410 | 750 | 800 | 32 | 152 | 820 | Conforming steel |
| 6 | F | 860 | 480 | 730 | 773 | 32 | 217 | 960 | Conforming steel |
| 7 | G | 910 | 340 | 780 | 840 | 32 | 208 | 680 | Conforming steel |
| 8 | H | 930 | 300 | 800 | 867 | 32 | 207 | 600 | Conforming steel |
| 9 | I | 855 | 500 | 725 | 767 | 34 | 189 | 1000 | Conforming steel |
| 10 | J | 960 | 250 | 830 | 907 | 34 | 235 | 500 | Conforming steel |
| 11 | K | 930 | 290 | 800 | 867 | 28 | 175 | 580 | Conforming steel |
| 12 | L | 860 | 480 | 730 | 773 | 28 | 237 | 960 | Conforming steel |
| 13 | M | 910 | 340 | 780 | 840 | 28 | 215 | 680 | Conforming steel |
| 14 | N | 870 | 440 | 740 | 787 | 28 | 209 | 880 | Conforming steel |
| 15 | O | 890 | 390 | 760 | 813 | 28 | 235 | 780 | Conforming steel |
| 16 | P | 890 | 390 | 760 | 813 | 31 | 158 | 780 | Conforming steel |
| 17 | Q | 860 | 480 | 730 | 773 | 31 | 249 | 960 | Conforming steel |
| 18 | R | 900 | 360 | 770 | 827 | 31 | 191 | 720 | Conforming steel |
| 19 | S | 895 | 370 | 765 | 820 | 32 | 170 | 740 | Conforming steel |
| 20 | T | 900 | 360 | 770 | 827 | 32 | 188 | 720 | Conforming steel |
| 21 | U | 890 | 390 | 760 | 813 | 32 | 238 | 780 | Conforming steel |
| 22 | V | 880 | 410 | 750 | 800 | 30 | 256 | 820 | Conforming steel |
| 23 | W | 890 | 380 | 760 | 813 | 30 | 189 | 760 | Conforming steel |
| 24 | X | 900 | 360 | 770 | 827 | 30 | 226 | 720 | Conforming steel |
| 25 | Y | 930 | 290 | 800 | 867 | 30 | 190 | 580 | Comparative steel |
| 26 | Z | 880 | 410 | 750 | 800 | 30 | 215 | 820 | Comparative steel |
| 27 | AA | 830 | 240 | 700 | 733 | 30 | 161 | 480 | Comparative steel |
| 28 | AB | 880 | 410 | 750 | 800 | 30 | 210 | 820 | Comparative steel |
| 29 | AC | 920 | 320 | 790 | 853 | 30 | 233 | 640 | Comparative steel |
| 30 | AD | 860 | 480 | 730 | 773 | 31 | 225 | 960 | Comparative steel |
| 31 | AE | 880 | 430 | 750 | 800 | 31 | 212 | 860 | Comparative steel |
| 32 | AF | 930 | 300 | 800 | 867 | 28 | 203 | 600 | Comparative steel |
| 33 | AG | 930 | 300 | 800 | 867 | 28 | 238 | 600 | Comparative steel |
| 34 | AH | 880 | 420 | 750 | 800 | 28 | 168 | 840 | Comparative steel |
| 35 | AI | 880 | 420 | 750 | 800 | 29 | 205 | 840 | Comparative steel |
| 36 | AJ | 880 | 410 | 750 | 800 | 29 | 175 | 820 | Comparative steel |
| 37 | AK | 930 | 300 | 800 | 867 | 29 | 174 | 600 | Comparative steel |
| 38 | AL | 930 | 300 | 800 | 867 | 30 | 221 | 600 | Comparative steel |
| 39 | AM | 930 | 300 | 800 | 867 | 30 | 243 | 600 | Comparative steel |
| 40 | E | 860 | 400 | 730 | 773 | 31 | 180 | 800 | Comparative steel |
| 41 | E | 880 | 400 | 750 | 800 | 30 | 196 | 800 | Comparative steel |
| 42 | E | 870 | 480 | 740 | 787 | 29 | 182 | 960 | Comparative steel |
| 43 | E | 890 | 480 | 760 | 813 | 29 | 167 | 960 | Comparative steel |
| 44 | E | 880 | 480 | 750 | 800 | 30 | 177 | 960 | Comparative steel |
| 45 | E | 880 | 300 | 750 | 827 | 31 | 214 | 600 | Comparative steel |
| 46 | E | 790 | 300 | 660 | 680 | 31 | 220 | 600 | Comparative steel |
| 47 | F | 970 | 300 | 840 | 920 | 31 | 206 | 600 | Conforming steel |
| 48 | F | 890 | 870 | 760 | 813 | 30 | 196 | 1740 | Conforming steel |
| 49 | F | 870 | 230 | 740 | 787 | 29 | 176 | 460 | Comparative steel |
| 50 | F | 870 | 360 | 670 | 693 | 28 | 189 | 720 | Comparative steel |
| 51 | F | 880 | 360 | 780 | 130 | 250 | 188 | 720 | Conforming steel |
| 52 | G | 870 | 360 | 740 | 787 | 280 | 202 | 720 | Comparative steel |
| 53 | G | 890 | 360 | 760 | 813 | 27 | 270 | 720 | Comparative steel |
| 54 | G | 850 | 360 | 720 | 760 | 28 | 140 | 720 | Comparative steel |
| 55 | G | 840 | 360 | 710 | 747 | 29 | 221 | 1560 | Comparative steel |
| 56 | H | 830 | 360 | 700 | 733 | 30 | 205 | 1400 | Conforming steel |
| 57 | H | 880 | 360 | 750 | 800 | 31 | 198 | 10 | Comparative steel |
| 58 | H | 870 | 360 | 740 | 787 | 30 | 190 | 30 | Conforming steel |
| 59 | H | 880 | 360 | 750 | 80 | 29 | 196 | 720 | Conforming steel |

The microstructure of each of the resulting steel sheets was subjected to measurement, and a tensile test and a test for evaluating the delayed fracture resistance were also performed. The measurement of the microstructure was performed by polishing an L-section (vertical section parallel to the rolling direction) of the steel sheet, etching the section with Nital, observing the section at a position 1/4 of the thickness of the steel sheet in the thickness direction from a surface of the steel sheet with a scanning electron microscope (SEM) at a magnification of 2,000× in four fields of view, and analyzing a captured SEM image by image analysis. Here, martensite and bainite are observed as regions that appear gray in the SEM image. Ferrite is observed as a region that appears black in the SEM image. The martensite and the bainite include trace amounts of carbide, nitride, sulfide, and oxide. Because it was difficult to exclude these trace substances, the area fractions of the martensite and the bainite included the area fractions of regions of these substances. Regarding the measurement of retained austenite, a surface layer of the steel sheet was subjected to chemical polishing with oxalic acid to a depth of 200 μm, and the resulting surface of the sheet was analyzed by an X-ray diffraction intensity method. The volume fraction of retained austenite was determined from integrated intensities of peaks of (200)α, (211)α, (220)α, (200)γ, (220)γ, and (311)γ diffraction planes measured with Mo-Kα radiation and was used as the area fraction of retained austenite.

Regarding inclusion clusters, the following measurement was performed: An L-section (vertical section parallel to the rolling direction) of the steel sheet was polished. No etching was performed. In a portion of the L-section extending from a position ⅕ of the thickness in the thickness direction from the top surface of the steel sheet to a position ⅕ of the thickness from the bottom surface across the center of the steel sheet in the thickness direction, regions with an area of 1.2 $mm^2$ each having an average inclusion density distribution were photographed sequentially in 30 fields of view with a SEM. The reason the measurement was performed in the above thickness range is that inclusion clusters specified in the disclosed embodiments were scarcely present on the surfaces of the steel sheet in the thickness direction. This is because the amounts of Mn and S segregated on the surfaces of the steel sheet in the thickness direction are small and because the dissolution of these inclusions occurs sufficiently on the high-temperature uppermost surfaces during heating of the slab, so that these inclusions are less likely to precipitate.

The above-mentioned regions were photographed at a magnification of 500× with the SEM. The resulting photographs were magnified as needed, and then the long-axis lengths of the inclusion particles, the long-axis cluster lengths of the inclusion clusters, and the distances between the inclusion particles were measured. In the case where it was difficult to determine the long-axis length, the long-axis cluster length, and the minimum interparticle distance, a SEM photograph taken at a magnification of 5,000× was used to determine them. The inclusions and so forth elongated in the rolling direction were targeted; thus, the direction in which the interparticle distance (minimum distance) was measured was limited to the rolling direction or a direction within the sector at an angle of ±10° with respect to the rolling direction. When an inclusion cluster is formed of two or more inclusion particles, the long-axis cluster length of the inclusion cluster was defined as the length between outer end portions of the inclusion particles in the rolling direction located at both ends of the inclusion cluster in the rolling direction. When an inclusion cluster is formed of one inclusion particle, the long-axis cluster length of the inclusion cluster was defined as the length of the inclusion particle in the rolling direction.

The local P concentration and the degree of Mn segregation were measured with an EPMA in the same methods as described above. In the tensile test, a JIS No. 5 tensile test piece was taken from each of the coils at a position 1/4 of the width of the coil in such a manner that a direction perpendicular to the rolling direction corresponds to the longitudinal direction of the test piece. The tensile test (according to JIS 22241) was performed to measure YP, TS, and El.

Regarding the evaluation of the delayed fracture resistance of each of the steel sheets, delayed fracture occurring at a sheared edge surface itself was evaluated. In the evaluation of the delayed fracture occurring at the sheared edge surface itself, a strip test specimen was taken from each of the coils at a position ¼ of the width of the coil so as to have a width of 30 mm in a direction perpendicular to the rolling direction and a length of 110 mm in the rolling direction, and was subjected to the evaluation. An edge surface of the 110-mm-long specimen in the longitudinal direction was formed by shearing.

FIG. 1 is a schematic view illustrating shearing to form an edge surface. FIG. 1(*a*) is a front view, and FIG. 1(*b*) is a side view. Shearing was performed in such a manner that the shear angle illustrated in FIG. 1(*a*) was 0° and the clearance illustrated in FIG. 1(*b*) was 15% of the sheet thickness. The evaluation target was the free end side without the sheet retainer illustrated in FIG. 1. The reason for this is that, from experience, delayed fracture at the sheared edge surface itself is more likely to occur on the free end side.

High residual stress is present on a sheared edge surface. When hydrogen is added, for example, by acid immersion, fine delayed fracture cracking occur on the sheared edge surface without applying an external force, for example, by bending. In this example, the specimens were immersed in hydrochloric acid with pH adjusted to 3 for 100 hours.

It was difficult to determine the frequency and depth of the delayed fracture cracks from the external appearance; thus, each strip test specimen was cut to form cross-sections perpendicular to the rolling direction. Each of the cross-sections was polished without etching and then observed with an optical microscope. In this cross-section observation, a crack extending from the sheared edge surface to a depth of 30 μm or more was determined as a delayed fracture crack. Fine cracks less than 30 μm in length do not adversely affect the performance of automotive components. Thus, the fine cracks were excluded from the delayed fracture cracks. To evaluate the frequency of the delayed fracture cracks with high accuracy, five strip test specimens were prepared for one type of steel, and the frequency of delayed fracture was calculated by observing 10 fields of view for each strip test specimen. The observation test pieces were cut out from each 110-mm-long strip test specimen at intervals of 10 mm. Steel sheets having a frequency of delayed fracture of 50% or more were rated as poor delayed fracture properties "x". Steel sheets having a frequency of delayed fracture of less than 50% were rated as good delayed fracture properties "○". Steel sheets having a frequency of delayed fracture of 25% or less were rated as excellent delayed fracture properties "⊙". These ratings are presented in the column "Delayed fracture resistance".

TABLE 3

| | | Microstructure | | | | | | | |
|---|---|---|---|---|---|---|---|---|---|
| No | Steel No | Area fraction of martensite + bainite (%) | Area fraction of balance (%) | Number of inclusion clusters per $mm^2$ (pieces/$mm^2$) | Local P concentration (%) | Degree of Mn segregation | Tensile strength (MPa) | Delayed fracture resistance | Remarks |
| 1 | A | 100 | 0 | 3 | 0.028 | 1.25 | 1372 | ○ | Conforming steel |
| 2 | B | 100 | 0 | 3 | 0.022 | 1.25 | 2075 | ○ | Conforming steel |
| 3 | C | 100 | 0 | 3 | 0.022 | 1.21 | 1369 | ○ | Conforming steel |

TABLE 3-continued

| No | Steel No | Microstructure: Area fraction of martensite + bainite (%) | Area fraction of balance (%) | Number of inclusion clusters per mm$^2$ (pieces/mm$^2$) | Local P concentration (%) | Degree of Mn segregation | Tensile strength (MPa) | Delayed fracture resistance | Remarks |
|---|---|---|---|---|---|---|---|---|---|
| 4 | D | 100 | 0 | 3 | 0.027 | 1.26 | 1475 | ○ | Conforming steel |
| 5 | E | 100 | 0 | 3 | 0.039 | 1.24 | 1662 | ○ | Conforming steel |
| 6 | F | 100 | 0 | 3 | 0.028 | 1.28 | 1658 | ○ | Conforming steel |
| 7 | G | 100 | 0 | 2 | 0.017 | 1.31 | 1736 | ○ | Conforming steel |
| 8 | H | 100 | 0 | 3 | 0.029 | 1.40 | 1749 | ○ | Conforming steel |
| 9 | I | 100 | 0 | 2 | 0.024 | 1.31 | 1910 | ○ | Conforming steel |
| 10 | J | 100 | 0 | 4 | 0.035 | 1.29 | 1684 | ○ | Conforming steel |
| 11 | K | 100 | 0 | 1 | 0.029 | 1.20 | 1480 | ○ | Conforming steel |
| 12 | L | 100 | 0 | 2 | 0.041 | 1.27 | 1491 | ○ | Conforming steel |
| 13 | M | 100 | 0 | 2 | 0.042 | 1.29 | 1592 | ○ | Conforming steel |
| 14 | N | 100 | 0 | 4 | 0.026 | 1.37 | 1537 | ⊙ | Conforming steel |
| 15 | O | 100 | 0 | 3 | 0.016 | 1.30 | 1556 | ⊙ | Conforming steel |
| 16 | P | 100 | 0 | 3 | 0.021 | 1.28 | 1796 | ⊙ | Conforming steel |
| 17 | Q | 100 | 0 | 1 | 0.022 | 1.34 | 1722 | ⊙ | Conforming steel |
| 18 | R | 100 | 0 | 1 | 0.032 | 1.20 | 1321 | ⊙ | Conforming steel |
| 19 | 5 | 100 | 0 | 2 | 0.034 | 1.21 | 1696 | ⊙ | Conforming steel |
| 20 | T | 100 | 0 | 1 | 0.035 | 1.19 | 1689 | ⊙ | Conforming steel |
| 21 | U | 100 | 0 | 2 | 0.029 | 1.17 | 1375 | ⊙ | Conforming steel |
| 22 | V | 100 | 0 | 2 | 0.025 | 1.20 | 1326 | ⊙ | Conforming steel |
| 23 | W | 100 | 0 | 2 | 0.027 | 1.22 | 1428 | ⊙ | Conforming steel |
| 24 | X | 100 | 0 | 3 | 0.035 | 1.20 | 1392 | ○ | Conforming steel |
| 25 | Y | 100 | 0 | 3 | 0.031 | 1.17 | 1296 | x | Comparative steel |
| 26 | Z | 100 | 0 | 3 | 0.034 | 1.31 | 2160 | x | Comparative steel |
| 27 | AA | 100 | 0 | 1 | 0.027 | 1.28 | 1641 | x | Comparative steel |
| 28 | AB | 100 | 0 | 1 | 0.068 | 1.24 | 1527 | x | Comparative steel |
| 29 | AC | 100 | 0 | 7 | 0.035 | 1.28 | 1491 | x | Comparative steel |
| 30 | AD | 100 | 0 | 6 | 0.018 | 1.17 | 1645 | x | Comparative steel |
| 31 | AE | 100 | 0 | 6 | 0.035 | 1.23 | 1651 | x | Comparative steel |
| 32 | AF | 100 | 0 | 7 | 0.033 | 1.22 | 1901 | x | Comparative steel |
| 33 | AG | 100 | 0 | 3 | 0.038 | 1.19 | 1741 | x | Comparative steel |
| 34 | AH | 100 | 0 | 1 | 0.043 | 1.23 | 1334 | x | Comparative steel |
| 35 | Al | 100 | 0 | 18 | 0.049 | 1.19 | 1334 | x | Comparative steel |
| 36 | AJ | 100 | 0 | 1 | 0.038 | 1.16 | 1481 | x | Comparative steel |
| 37 | AK | 100 | 0 | 16 | 0.014 | 1.24 | 1602 | x | Comparative steel |
| 38 | AL | 100 | 0 | 12 | 0.020 | 1.27 | 1515 | x | Comparative steel |
| 39 | AM | 100 | 0 | 1 | 0.024 | 1.32 | 1440 | x | Comparative steel |
| 40 | E | 100 | 0 | 4 | 0.063 | 1.58 | 1638 | x | Comparative steel |
| 41 | E | 100 | 0 | 4 | 0.054 | 1.52 | 1603 | x | Comparative steel |
| 42 | E | 100 | 0 | 4 | 0.053 | 1.54 | 1629 | x | Comparative steel |
| 43 | E | 100 | 0 | 4 | 0.039 | 1.53 | 1635 | x | Comparative steel |
| 44 | E | 100 | 0 | 4 | 0.045 | 1.53 | 1628 | x | Comparative steel |
| 45 | E | 100 | 0 | 3 | 0.051 | 1.25 | 1578 | x | Comparative steel |
| 46 | E | 89 | 11 | 3 | 0.045 | 1.23 | 1308 | x | Comparative steel |
| 47 | F | 100 | 0 | 3 | 0.024 | 1.20 | 1596 | ○ | Conforming steel |
| 48 | F | 100 | 0 | 2 | 0.023 | 1.21 | 1665 | ○ | Conforming steel |
| 49 | F | 100 | 0 | 2 | 0.028 | 1.24 | 1706 | x | Comparative steel |
| 50 | F | 93 | 7 | 2 | 0.023 | 1.27 | 1689 | x | Comparative steel |
| 51 | F | 96 | 4 | 1 | 0.022 | 1.26 | 1683 | ○ | Conforming steel |
| 52 | G | 100 | 0 | 1 | 0.021 | 1.27 | 1773 | x | Comparative steel |
| 53 | G | 100 | 0 | 2 | 0.028 | 1.33 | 1667 | x | Comparative steel |
| 54 | G | 100 | 0 | 2 | 0.019 | 1.30 | 1870 | x | Comparative steel |
| 55 | G | 100 | 0 | 3 | 0.013 | 1.24 | 1768 | x | Comparative steel |
| 56 | H | 100 | 0 | 4 | 0.024 | 1.30 | 1822 | ○ | Conforming steel |
| 57 | H | 100 | 0 | 3 | 0.018 | 1.28 | 1796 | x | Comparative steel |
| 58 | H | 100 | 0 | 3 | 0.018 | 1.27 | 1814 | ○ | Conforming steel |
| 59 | H | 95 | 5 | 3 | 0.019 | 1.30 | 1799 | ○ | Conforming steel |

As presented in Table 3, each of the steels having optimal component compositions and obtained under optimal hot-rolling and annealing conditions had a tensile strength (TS) of 1,320 MPa or more and excellent delayed fracture properties at the sheared edge surfaces.

Example 2

A steel sheet produced under production condition No. 1 (example of the disclosed embodiments) in Table 2 in Example 1 was subjected to galvanization treatment to form a galvanized steel sheet, followed by pressing to form a member of the example of the disclosed embodiments. A galvanized steel sheet produced by subjecting a steel sheet produced under production condition No. 1 (example of the disclosed embodiments) in Table 2 in Example 1 to galvanization treatment and a galvanized steel sheet produced by subjecting a steel sheet produced under production condition No. 2 (example of the disclosed embodiments) in Table 2 in Example 1 to galvanization treatment were bonded by spot welding to produce a member of the example of the disclosed embodiments. These members of the examples of the disclosed embodiments were subjected to the evaluation of delayed fracture occurring at the sheared edge surfaces themselves and found that these members had good delayed fracture properties "○". The results demonstrate that these members can be suitably used for automotive components and so forth.

Similarly, a steel sheet produced under production condition No. 1 (example of the disclosed embodiments) in Table 2 in Example 1 was pressed to form a member of the example of the disclosed embodiments. A steel sheet produced under production condition No. 1 (example of the disclosed embodiments) in Table 2 in Example 1 and a steel sheet produced under production condition No. 2 (example of the disclosed embodiments) in Table 2 in Example 1 were bonded by spot welding to form a member of the example of the disclosed embodiments. These members of the examples of the disclosed embodiments were subjected to the evaluation of delayed fracture occurring at the sheared edge surfaces themselves and found that these members had good delayed fracture properties "○". The results demonstrate that these members can be suitably used for automotive components and so forth.

The invention claimed is:

1. A steel sheet having a chemical composition comprising, by mass %:

C: 0.13% or more and 0.40% or less;
Si: 1.5% or less;
Mn: 1.7% or less;
P: 0.010% or less;
S: 0.0020% or less;
sol. Al: 0.20% or less;
N: less than 0.0055%,%;
O: 0.0025% or less;
Nb: 0.002% or more and 0.035% or less;
Ti: 0.002% or more and 0.10% or less;
B: 0.0002% or more and 0.0035% or less; and
the balance being Fe and incidental impurities, wherein the steel sheet has a microstructure including martensite and bainite, a total area fraction of the martensite and the bainite being in a range of 95% or more and 100% or less, the balance being one or more selected from ferrite and retained austenite, and a total of (i) a density of inclusion particles having a long-axis length in a range of 20 μm or more and 80 μm or less and a minimum interparticle distance of more than 10 μm and (ii) a density of inclusion particle clusters each having a long-axis cluster length in a range of 20 μm or more and 80 μm or less and each including two or more inclusion particles having a long-axis length of 0.3 μm or more and a minimum interparticle distance of 10 μm or less is 5 pieces/$mm^2$ or less, a local P concentration in a region extending from a position 1/4 of a thickness of the steel sheet in a thickness direction from a surface of the steel sheet to a position 3/4 of the thickness of the steel sheet in the thickness direction from the surface of the steel sheet is 0.060% or less by mass, and a degree of Mn segregation in the region is 1.50 or less, the steel sheet has a tensile strength of 1,320 MPa or more, and formulae (1) and (2) are satisfied:

$$[\%\ Ti]+[\%\ Nb]>0.007 \quad (1)$$

$$[\%\ Ti]\times[\%\ Nb]^2\leq 7.5\times10^{-6} \quad (2)$$

where, in each of formulae (1) and (2), [% Nb] and [% Ti] are a Nb content (%) and a Ti content (%), respectively, of the steel sheet.

2. The steel sheet according to claim 1, wherein the chemical composition further comprises at least one group selected from the following groups:

Group A: at least one element selected from the group consisting of, by mass %, Cu: 0.01% or more and 1% or less, and Ni: 0.01% or more and 1% or less, Group B: at least one element selected from the group consisting of, by mass %, Cr: 0.01% or more and 1.0% or less, Mo: 0.01% or more and less than 0.3%, V: 0.003% or more and 0.45% or less, Zr: 0.005% or more and 0.2% or less, and W: 0.005% or more and 0.2% or less, Group C: at least one element selected from the group consisting of, by mass %, Sb: 0.002% or more and 0.1% or less, and Sn: 0.002% or more and 0.1% or less, and Group D: at least one element selected from the group consisting of, by mass %, Ca: 0.0002% or more and 0.0050% or less, Mg: 0.0002% or more and 0.01% or less, and a REM: 0.0002% or more and 0.01% or less.

3. The steel sheet according to claim 1, further comprising a zinc-coated layer on the surface.

4. A method for producing a steel sheet according to claim 1, the method comprising:

in performing continuous casting of a slab from a molten steel having the chemical composition at a difference between a casting temperature and a solidification temperature in a range of 10° C. or higher and 40° C. or lower, the continuous casting including cooling the slab at a specific water flow in a range of 0.5 L/kg or more and 2.5 L/kg or less until a temperature of a surface layer portion of a solidifying shell reaches 900° ° C. in a secondary cooling zone, and passing the slab having a temperature in a range of 600° ° C. or higher and 1,100° ° C. or lower through a bending zone and a straightening zone, subsequently, holding a surface temperature of the slab at 1,220° C. or higher for 30 minutes or more, then hot-rolling the slab into a hot-rolled steel sheet, cold-rolling the hot-rolled steel sheet at a cold rolling reduction rate of 40% or more into a cold-rolled steel sheet, and performing continuous annealing of the cold-rolled steel sheet, the continuous annealing including subjecting the cold-rolled steel sheet to soaking treatment at 800° C. or higher for 240 seconds or more, cooling the steel sheet from a temperature of 680° C. or higher to a temperature of 260° C. or lower at an average cooling rate of 70° C./s or more, reheating the steel sheet, and then holding the steel sheet in a temperature range of 150° ° C. to 260° C. for in a range of 20 to 1,500 seconds.

5. The method for producing a steel sheet according to claim 4, wherein, after the continuous annealing, a coating treatment is performed.

6. A member obtained by subjecting the steel sheet according to claim 1 to at least one of forming and welding.

7. A method for producing a member, the method comprising a step of subjecting a steel sheet produced by the method for producing a steel sheet according to claim 4 to at least one of forming and welding.

8. The steel sheet according to claim 2, further comprising a zinc-coated layer on the surface.

9. A method for producing a steel sheet according to claim 2, the method comprising:

in performing continuous casting of a slab from a molten steel having the chemical composition at a difference between a casting temperature and a solidification temperature in a range of 10° C. or higher and 40° ° C. or lower, the continuous casting including cooling the slab at a specific water flow in a range of 0.5 L/kg or more and 2.5 L/kg or less until a temperature of a surface layer portion of a solidifying shell reaches 900° C. in a secondary cooling zone, and passing the slab having a temperature in a range of 600° C. or higher and 1,100° C. or lower through a bending zone and a straightening zone, subsequently, holding a surface temperature of the slab at 1,220° ° C. or higher for 30 minutes or more, then hot-rolling the slab into a hot-rolled steel sheet, cold-rolling the hot-rolled steel sheet at a cold rolling reduction rate of 40% or more into a cold-rolled steel sheet, and performing continuous annealing of the cold-rolled steel sheet, the continuous annealing including subjecting the cold-rolled steel sheet to soaking treatment at 800° C. or higher for 240 seconds or more, cooling the steel sheet from a temperature of 680° C. or higher to a temperature of 260° C. or lower at an average cooling rate of 70° C./s or more, reheating the steel sheet, and then holding the steel sheet in a temperature range of 150° C. to 260° ° C. for in a range of 20 to 1,500 seconds.

10. The method for producing a steel sheet according to claim 9, wherein, after the continuous annealing, a coating treatment is performed.

11. A member obtained by subjecting the steel sheet according to claim 2 to at least one of forming and welding.

12. A member obtained by subjecting the steel sheet according to claim 3 to at least one of forming and welding.

13. A member obtained by subjecting the steel sheet according to claim 8 to at least one of forming and welding.

14. A method for producing a member, the method comprising a step of subjecting a steel sheet produced by the method for producing a steel sheet according to claim 9 to at least one of forming and welding.

15. A method for producing a member, the method comprising a step of subjecting a steel sheet produced by the method for producing a steel sheet according to claim 5 to at least one of forming and welding.

16. A method for producing a member, the method comprising a step of subjecting a steel sheet produced by the method for producing a steel sheet according to claim 10 to at least one of forming and welding.

* * * * *